US008091361B1

(12) United States Patent
Lang

(10) Patent No.: US 8,091,361 B1
(45) Date of Patent: Jan. 10, 2012

(54) METHOD AND APPARATUS FOR CONTROLLING THE FINAL FEEDWATER TEMPERATURE OF A REGENERATIVE RANKINE CYCLE USING AN EXERGETIC HEATER SYSTEM

(75) Inventor: Fred D. Lang, San Rafael, CA (US)

(73) Assignee: Exergetic Systems, LLC, San Rafael, CA (US)

( * ) Notice: Subject to any disclaimer, the term of this patent is extended or adjusted under 35 U.S.C. 154(b) by 707 days.

(21) Appl. No.: 12/290,944

(22) Filed: Nov. 4, 2008

Related U.S. Application Data

(60) Provisional application No. 61/192,055, filed on Sep. 12, 2008, provisional application No. 61/135,568, filed on Jul. 22, 2008, provisional application No. 61/135,261, filed on Jul. 19, 2008, provisional application No. 61/001,858, filed on Nov. 5, 2007.

(51) Int. Cl.

| | |
|---|---|
| ***F01K 9/00*** | (2006.01) |
| ***F01K 19/10*** | (2006.01) |
| ***F01K 7/34*** | (2006.01) |
| ***F01K 23/06*** | (2006.01) |
| ***F01K 13/00*** | (2006.01) |

(52) U.S. Cl. ..... 60/654; 60/653; 60/670; 60/677; 60/678

(58) Field of Classification Search ..... 60/645, 60/653, 654, 670, 677, 678
See application file for complete search history.

(56) References Cited

U.S. PATENT DOCUMENTS

| | | | | |
|---|---|---|---|---|
| 3,842,605 | A * | 10/1974 | Tegtmeyer | 60/678 |
| 3,972,196 | A * | 8/1976 | Silvestri, Jr. | 60/677 |
| 3,973,402 | A * | 8/1976 | Silvestri, Jr. | 60/678 |
| 4,047,386 | A * | 9/1977 | Frondorf | 60/654 |
| 7,040,095 | B1 * | 5/2006 | Lang | 60/653 |

FOREIGN PATENT DOCUMENTS

WO WO 9711259 A1 * 3/1997

* cited by examiner

*Primary Examiner* — Thomas Denion
*Assistant Examiner* — Christopher Jetton

(57) ABSTRACT

This invention relates to a method and apparatus for increasing the final feedwater temperature associated with a regenerative Rankine cycle, said cycle commonly used in thermal systems such as conventional power plants, whose steam generators are fired with a fossil fuel and whose regenerative Rankine cycle employs a reheating of the working fluid. This invention involves the placement of an Exergetic Heater System in the feedwater path of the regenerative Rankine cycle. The Exergetic Heater System conditions and heats feedwater such that the temperature of the cycle's final feedwater as it enters the steam generator has reached a desired value. The Exergetic Heater System receives its driving steam from an Intermediate Pressure turbine extraction.

10 Claims, 15 Drawing Sheets

-prior art-

-prior art-

FIG. 5
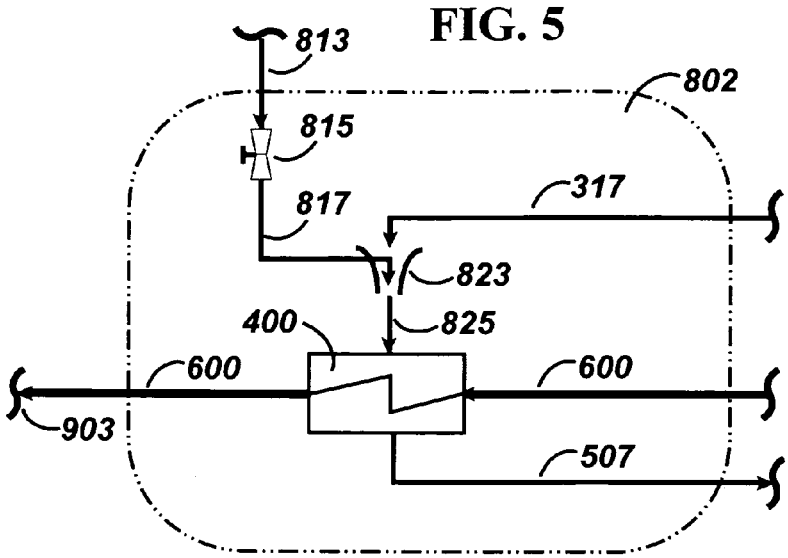
FIG. 6 (revised)
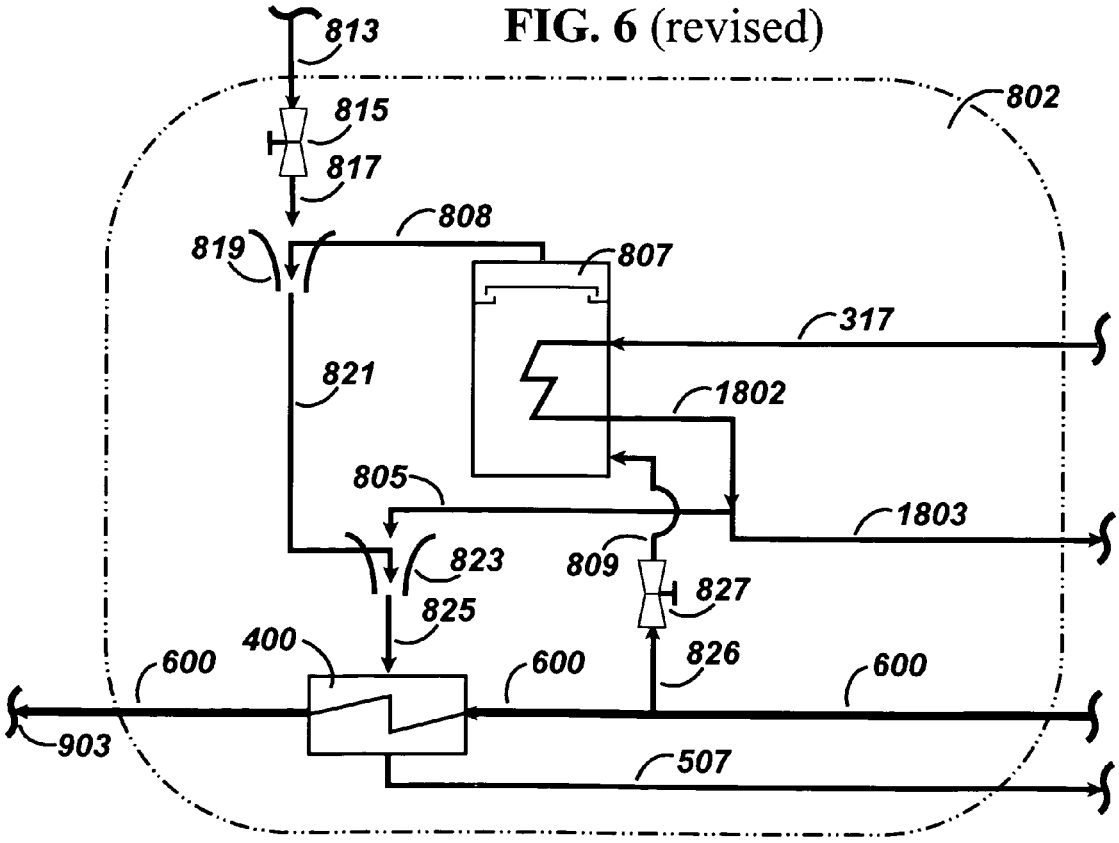

METHOD AND APPARATUS FOR CONTROLLING THE FINAL FEEDWATER TEMPERATURE OF A REGENERATIVE RANKINE CYCLE USING AN EXERGETIC HEATER SYSTEM

CROSS-REFERENCE TO RELATED APPLICATIONS

This application claims benefit of priority of U.S. Provisional Application No. 61/001,858 filed Nov. 5, 2007 by the same inventor, the disclosure of which is incorporated herein by reference in its entirety and for all purposes. In addition, this application also claims benefit of priority of U.S. Provisional Application No. 61/135,261 filed Jul. 19, 2008 by the same inventor, the disclosure of which is incorporated herein by reference in its entirety and for all purposes. In addition, this application also claims benefit of priority of U.S. Provisional Application No. 61/135,568 filed Jul. 22, 2008 by the same inventor, the disclosure of which is incorporated herein by reference in its entirety and for all purposes. In addition, this application also claims benefit of priority of U.S. Provisional Application No. 61/192,055 filed Sep. 12, 2008 by the same inventor, the disclosure of which is incorporated herein by reference in its entirety and for all purposes.

FIELD OF THE INVENTION

This invention relates to a method and apparatus for increasing the final feedwater temperature associated with a regenerative Rankine cycle, said cycle commonly used in thermal systems such as conventional power plants, whose steam generators are fired with a fossil fuel and whose regenerative Rankine cycle employs a reheating of the working fluid. This invention involves the placement of an Exergetic Heater System in the feedwater path of the regenerative Rankine cycle. The Exergetic Heater System conditions and heats feedwater such that the temperature of the cycle's final feedwater, as it enters the steam generator, has reached a desired value. The Exergetic Heater System receives its driving steam from an Intermediate Pressure turbine extraction.

BACKGROUND OF THE INVENTION

The regenerative Rankine cycle has been used by the electric power industry for over 100 years. Most commonly the working fluid in these cycles is water. The regenerative Rankine cycle takes steam from a steam generator, produces shaft power by expanding the steam in a turbine, and then condenses the expanded steam in a condenser. Primary heating of the cycle's working fluid occurs in the steam generator, driven by the combustion of fossil fuel. Many modern regenerative Rankine cycles employ a reheating of the steam after an initial expansion in a High Pressure (HP) turbine. After reheating by combustion gases in a Reheater heat exchanger, integral to the steam generator, the steam is returned to the turbine cycle for further expansion in an Intermediate Pressure (IP) turbine, followed by expansion in a Low Pressure (LP) turbine; the LP turbine's exhaust is then condensed in a condenser. Note that if an IP turbine is present (accepting steam from a Reheater), its exhaust temperature is commonly higher than the HP turbine's exhaust temperature. The condensate from the condenser, or feedwater, is then routed by pumps through a series of feedwater heaters in which it is re-heated (regenerated). The heating vehicle for the feedwater is extraction steam obtained from the turbine. Feedwater heaters may be of a contact type or a closed type of heat exchanger. A closed type of heater is also termed a surface type heater; this type of heater has a shell-side and a tube-side configuration where, typically, the shell-side contains the heating fluid (extraction steam) and the tube-side contains the fluid being heated (feedwater). With a contact type of heater the extraction steam is directly mixed with feedwater, the heated feedwater/condensed steam, in a subcooled state, being pumped to the next highest pressure heater. A contact type of heater is also termed an "open" type heater. With a closed type of heater the extraction steam is contained on the shell-side of the heat exchanger, the feedwater carried within tubes. A classical text on the subject of regenerative Rankine cycles used in power plants is by J. Kenneth Salisbury, *Steam Turbines and Their Cycles*, Robert E. Krieger Publishing Company, Huntington, N.Y., 1950 (reprinted 1974), especially pages 43-93 and 266-273.

For feedwater heaters, feedwater is classically heated through the condensation of steam which has been extracted from the turbine, its latent heat being the principal heat transferred. Condensing heat transfer is solely dependent on the saturation temperature associated with the extracting steam, and is thus dependent on the extraction pressure delivered by the turbine. Extraction pressures are governed by the turbine's Flow Passing Ability as integrally established by the next downstream nozzle from the point of extraction. The Flow Passing Ability at any point in a steam turbine represents a reduction of Bernoulli's Equation associated with fluid passing through a nozzle (in the case of a turbine, a ring of nozzles forming the inlet to a turbine stage). When nozzles erode their flow area increases, causing, for a given mass flow, a reduction in inlet pressure and thus a reduction in the associated extraction pressure. A degradation in extraction pressure will degrade a feedwater heater's condensing heat transfer mechanism resulting in a lower feedwater temperature.

A common design practice in Europe is to supply the top heater its extraction steam from a mid-point IP turbine extraction, and to supply the next to the top feedwater heater its extraction steam from the HP turbine's exhaust. An improved balance of shell-side to tube-side differential exergies is obtained using this design, even through the second highest pressure extraction steam (from the IP turbine) is used to heat the top heater, the last feedwater heater in the cycle. The shell-side outlet of the top heater, always in a super-heated state, is then routed to a third feedwater heater where it is condensed; as is the drain flow from the second heater. With the European design, the third feedwater heater does not receive extraction steam from the turbine. Refer to FIG. 1. Therefore there are two fundamental differences in the European arrangement when compared to this invention: 1) there is no use of a plurality of condensing feedwater heaters placed in series along the feedwater path, said heaters all using the same turbine extraction steam; and 2) there is no mechanism by which the pressure of the extraction steam is increased (for the last or any feedwater heater in the system) allowing its latent heat to be removed thus minimizing extraction steam flow.

A common design practice in North America is to supply the highest pressure feedwater heater its extraction steam from the HP turbine's exhaust. This highest pressure feedwater heater is the last heater the feedwater encounters before returning to the steam generator (it is also termed the "top heater"). The second highest pressure feedwater heater is supplied extraction steam from the IP turbine. The third highest pressure feedwater heater is supplied extraction steam from the next lowest extraction pressure available from the turbine; and so forth. Refer to FIG. 3. Therefore there are two fundamental differences in the North American arrangement when compared to this invention: 1) there is no use of a plurality of condensing feedwater heaters placed in series along the feedwater path, said heaters all using the same turbine extraction steam; and 2) there is no mechanism by which the pressure of the extraction steam is increased allowing its latent heat to be removed thus minimizing extraction steam flow.

For any large steam turbine system the High Pressure (HP) turbine's exhaust pressure is controlled by the next downstream turbine's Flow Passing Ability. For a modern design, the next downstream turbine is typically the IP turbine. Thus if the nozzles associated with the first stage of an IP turbine erode, the exhaust pressure associated with the HP turbine will degrade, and will thus degrade the associated feedwater heater. In summary, the inlet area of the first nozzles of an IP turbine will control all upstream pressures: throughout the Reheater heat exchanger, the Reheater piping, and indeed the HP turbine's backpressure (the HP exhaust). When the HP turbine's exhaust is bled to the highest pressure feedwater heater and the IP inlet nozzle area has eroded, extraction pressure to this heater and thus its saturation temperature will degraded, and thus final feedwater temperature will degrade. Inlet nozzles of IP turbines erode, typically from solid particles trapped in the steam. Traditionally, and especially for the older machine, they go un-repaired for years given that full electrical generation may still be achieved using higher feedwater flows, and with ever increasing consumption of fuel and combustion air. This situation is aggravated if the power plant's over-sight authority (typically a public utility commission or public service commission) which typically allows ever higher fuel costs to be passed onto the electricity customers. However, eventually capacity issues arise from such higher flows. Examples of equipment limitations resultant from such higher flows include: limitations imposed by a combustion air fan; limitations imposed by an induce draft fan controlling combustion gas back-pressures; limitations imposed by a coal mill's capacity; limitations imposed by the capacity of feedwater pumps; limitations imposed by an auxiliary steam turbine driving a feedwater pump; and the like.

Prior art relevant to the present invention is described in U.S. Pat. No. 7,040,095 issued May 9, 2006, hereinafter '095. The inventor of '095 and the inventor of this disclosure is the same person. '095 teaches to route IP extraction steam to an Exergetic Heater, thereby heating feedwater. '095 does not employ a compressor device to increase the pressure of the IP extraction steam. The key distinction between '095 and this disclosure lies with inherent thermodynamic limitations associated with '095. '095 teachings simply do not address the situation where minimum steam flow is desired (thus minimizing lost electrical or mechanical power), while at the same time achieving a high increase in feedwater temperature. An IP turbine extraction produces steam at a lower pressure than that associated with the final feedwater. The saturation temperature associated with IP turbine extraction steam is not high enough for heating of feedwater using the extraction steam's latent heat. If the desired increase in final feedwater temperature is moderate, then using low pressure IP steam (given its very high temperature) is a viable solution as taught in '095. In essence, such use of '095 invokes a "trimming" process to the Rankine cycle. However, if the desired final feedwater temperature is high the Exergetic Heater of '095 must be designed to transfer heat from IP steam whose shell outlet temperature is higher than the desired final feedwater temperature. Obviously the Second Law can not be violated. The problem arises in that a low IP extraction pressure will not allow the latent heat to be removed thus requiring higher flow rates of IP extraction steam if a high final feedwater temperature is desired. Although '095 is a viable invention as it teaches how final feedwater temperature may be recovered, but the price of such recovery is high regards potentially high extraction steam flows and subsequent loss of turbine power.

As an example of '095 teachings, consider parameters from an actual 712 MWe coal-fired power plant. An 9.8 ΔF increase in feedwater for this unit may be achieved using 260 psiA IP turbine extraction steam at 279,695 lbm/hr flow, or 5.39% of feedwater flow. Although an additional 279,695 lbm/hr of extraction steam may appear high, it could be well viewed as a final feedwater temperature trim, justified by improved plant thermal efficiency. However, a 28.6 ΔF increase in feedwater, achieved using the same '095 Exergetic Heater, driven from the same IP extraction, will require 868, 148 lbm/hr or 16.75% of feedwater flow. Such a burden on the system, especially on the Deaerator unit (DA, termed a Feedwater Tank in Europe), could easily exceed design capacity given such high flows. In addition, bear in mind this steam is derived from the IP turbine, resulting in less shaft power being developed. Improvement is required over the '095 invention.

With the preceding paragraphs in mind, the imagination must question the very nature of the regenerative Rankine cycle. Such inquiry extends far beyond the use of '095 technology and its "trimming" mechanism. What is meant is that the boundary condition of the regenerative Rankine cycle, its final feedwater temperature, is fundamentally controlled by turbine steam path pressure. Specifically, such control results form the IP turbine's flow passing ability (i.e., IP turbine's inlet pressure). In addition, as the system's power output is reduced, final feedwater temperature falls in proportion to IP inlet pressure. Why? This inherent limitation makes power plants inefficient at part loads. For fossil-fired systems this means proportionally higher green-house gas emissions per unit of output shaft power. Further still, most modern conventional power plants are designed to operate in an over-pressure main steam condition (such as 2535 psiA throttle pressure, versus a nominal 2400 psiA). Under such conditions, and of course using a higher feedwater flow, the entire turbine steam path is pressurized (i.e., with higher pressures and flows than that associated with a throttle pressure of 2400 psiA). If the steam generator is designed for the higher final feedwater temperature associated with over-pressure (typically an additional +30 ΔF in final feedwater temperature), such potential should be utilized. This utilization means that the system would employ a higher final feedwater temperature, but whose feedwater flow would be associated with a lower (routine) throttle pressure. '095 teaches no practical method of gaining such high feedwater temperature increases without major equipment modifications given its requirement for very high steam flows form the IP turbine; and, given high steam flows, high lost of turbine shaft output.

There is no known art other than '095 which has addressed the issue of degraded feedwater temperature at the operational level. IP turbine nozzle erosion will degrade the final feedwater temperature on North American steam plants, and will affect system thermal efficiency causing higher consumption of fuel. The Exergetic Heater of '095, although viable for small temperature increases, for "trimming", will cause high extraction steam flows to be used to gain high final feedwater temperatures, and thus an unreasonable lost of shaft power. There is no known art which utilizes the higher feedwater temperature associated with a fossil-fired, over-pressure design, given the plant is nominally operated. The responsible power plant operator is in need of a solution to degraded feedwater temperature, and/or capturing the advantages of an over-pressure design, using minimum turbine extraction steam while at the same time maintaining routine feedwater flows.

There is no known design other than '095, which extracts steam from a turbine to directly heat a plurality of condensing feedwater heaters placed in series along the feedwater path. There is no known application, including '095, where a turbine's extraction steam pressure leading to a final feedwater heater, is increased such that the latent heat of the extraction steam is removed and delivered to the feedwater, thus minimizing extraction flow and achieving the desired final feedwater temperature.

It is known that a single LP turbine extraction may be designed to deliver steam to a plurality of condensing feedwater heaters, but heaters operating with the essentially same inlet feedwater conditions. These are parallel heater configurations, not series. For example, if a regenerative Rankine cycle's LP feedwater heaters contain two groups of heaters, say 5A, 6A & 7A, and 5B, 6B & 7B (where 7A & 7B are the lowest pressure heaters both receiving condensate from the condenser, 5A and 5B being the higher pressure heaters), then a single turbine extraction may supply heaters 5A and 5B, another extraction supplying heaters 6A and 6B, and another extraction supplying heaters 7A and 7B. In yet another variation, as favored by the former Westinghouse Electric Corporation, Large Steam Turbine Division, it could be that heater 5A is being supplied an extraction which is different than that which heater 5B is being supplied; i.e., asymmetric extractions. However, other than '095, there is no known design which extracts a single source of turbine steam and supplies, for example, heaters 5A and 6B, or 6B and 7B, or 7A and 5A, or heaters 5A, 6A and 7A, etc. (i.e., heaters placed in series along the feedwater path). In summary, there is no known art other than '095 which advocates using a single turbine extraction to supply a plurality of feedwater heaters placed in series along the feedwater path. However, with '095, as explained, the price of extracting to heaters placed in series is a high extraction flow given that high final feedwater temperatures are desired.

It is to be noted that '095 discusses the use of a diffuser device (another name for a simple thermocompressor), but this is taken in context of increasing the pressure of the outlet steam from an Exergetic Heater such that it may flow to a higher pressure feedwater heater; not its inlet pressure; and not such that a condensing heat transfer mechanism might take place. '095 does not disclose the use of a compressor device to increase turbine extraction pressure.

Another prior art relevant to the present invention is described in U.S. Pat. No. 4,336,105 issued Jun. 22, 1982, hereinafter '105. '105 solved a problem dealing with a Nuclear Steam Supply System (NSSS). The invention was not concerned with increasing turbine cycle efficiency per se, given a saturated (or near saturated) output from a conventional nuclear steam generator. An IP turbine extraction producing highly superheated steam was simply not available. Rather '105 was concerned about preventing freezing of liquid sodium metal at low loads on the heating side of a non-conventional nuclear steam generator; i.e., applicable to a liquid metal cooled nuclear reactor system. '105 does not employ an IP turbine extraction to heat the feedwater (an IP turbine does not exist in '105), but HP steam found at the NSSS boundary (i.e., conditions inlet to the HP turbine). '105 does not employ an additional feedwater heater given that the invention employs HP (boundary) steam as delivered to a high pressure heater ('105 FIG. 1, item 44). Indeed, all feedwater heaters considered ('105 FIG. 1, items 40, 42 and 44), are prior art; i.e., in-situ equipment. Col. 2, Lines 55-57 of '105 discusses the operational mechanics of controlling the final feedwater temperature—relating extraction pressure to final feedwater temperature. However, such discussion in '105 is in the context of a solution for low load operation by manipulating the NSSS's Moisture Separator Reheater (MSR) pressures and flows such that proper feedwater heating could be achieved (see Col. 3, Lines 1-22 in '105), and thus to prevent freezing of the liquid sodium coolant.

Another prior art relevant to the present invention is described in U.S. Pat. No. 3,238,729 issued Mar. 8, 1966, hereinafter '729. This patent describes the use of a thermocompressor used to increase the pressure of a non-top heater; a device in which the final feedwater temperature is not altered. The '729 invention does not teach how the final feedwater temperature may be increased; this is not an objective of the invention. '729 FIG. 1 describes how a single turbine extraction supplies two feedwater heaters placed in series, but note that said heaters, features 31 and 29 in FIG. 1 of '729, are both non-condensing. Col. 3, Lines 13-17 of '729 states clearly that the steam associated with feature 31 is "... for the most part only fully or partly desuperheated and then passes on to the heater 27, in which it is condensed." The invention '729 clearly is a fore-runner to the modern European design discussed above.

Another prior art relevant to the present invention is described in European Patent 0 851 971 issued Sep. 4, 1996. This patent describes the use of thermocompressors to increase the pressure of extracted steam. No mention is made of increasing final feedwater temperature, unit thermal efficiency is not improved.

Another prior art relevant to the present invention is described in European Patent 0 773 348 issued May 14, 1997. This patent describes a low pressure turbine's extraction system in which the condensate's temperature is increased. Again, no mention is made of increasing final feedwater temperature, unit thermal efficiency is not improved.

Another prior art relevant to the present invention is described in U.S. Pat. No. 3,973,402 issued Aug. 10, 1976, hereinafter '402. This invention employs a "pressure-increasing ejector element" (i.e., a thermocompressor as used herein) to increase the extraction pressure of a top feedwater heater. '402 is applicable solely to a Nuclear Steam Supply System (NSSS). '402 does not employ IP turbine extraction steam but HP extraction steam as supply steam to the thermocompressor; motive steam is obtained as subcooled condensate from the NSSS's Moisture Separator Reheater (MSR). There is no description of a single turbine extraction feeding a plurality of condensing feedwater heaters placed in series.

There is a need to improve the thermal efficiency of a fossil-fired power plant which employs a Reheater, by increasing its final feedwater temperature. The need to increase final feedwater temperature may arise due to eroded IP turbine nozzles, a degraded top feedwater heater, a desired to improve thermal efficiency beyond design, and/or a desire to divorce final feedwater temperature from the inherent limitations of the regenerative Rankine cycle. Such improvement should minimize losses to turbine shaft power (e.g., electric generation). Such improvement should be design to increase thermal efficiency and thus to reduce the carbon footprint of the fossil-fired power plant.

SUMMARY OF THE INVENTION

This invention teaches to incorporate an Exergetic Heater System within a regenerative Rankine Cycle. The Exergetic Heater System comprises two components. The first component is a heat exchanger, termed an "Exergetic Heater", placed in the feedwater path, upstream from the steam generator. Said Exergetic Heater is configured such that feedwater is heated, said heating being accomplished from Intermediate Pressure (IP) turbine extraction steam. Typically an Exergetic Heater is a closed heat exchanger having a tube-in-shell configuration, the shell-side receiving heating steam, the tube-side carrying feedwater. The second component is a "compressor device" used to increase the pressure of the IP turbine extraction steam. Exergy is a thermodynamic term relating to the maximum potential for power production. In the context of this invention, an Exergetic Heater in combination with a compressor device, termed an Exergetic Heater System, assists the regenerative Rankine cycle in achieving both maximum thermal efficiency and output power. An Exergetic Heater System contains at least one Exergetic Heater and one compressor device. An Exergetic Heater System may also contain a plurality of Exergetic Heaters and compressor devices.

An Exergetic Heater System has the capacity to always heat feedwater to its final conditions, no matter the reason for a degradation in the feedwater heater's performance (by IP turbine nozzle erosion, higher extraction line pressure drops, degradation in heater performance from non-condensable gas buildup, etc.). Additionally, the Exergetic Heater System has the capacity to heat feedwater beyond its original design value, achieving a temperature associated with an over-pressure design, or beyond. It is an important feature of the present invention to use IP extraction steam since its temperature is sufficiently high to cause the proper heating of the feedwater within the Exergetic Heater. Minimum steam flow is achieved through use of a compressor device such that the steam's latent heat can be used to further heat feedwater. In the preferred embodiment the Exergetic Heater has a shell-side and a tube-side configuration. By design, turbine extraction steam enters the Exergetic Heater System as superheated steam and exits in the condensed, subcooled state. The exiting fluid then enters a lower pressure "in-situ feedwater heater", it having sufficient pressure and exergy to further assist feedwater heating.

With further detail, this invention teaches to route an IP turbine extraction steam to an Exergetic Heater System. Within the Exergetic Heater System, the IP turbine extraction steam may first encounter either a compressor device or an Exergetic Heater within an Exergetic Heater System, or may first encounter a desuperheating heat exchanger then followed by an Exergeiic Heater System When applying the invention to a typical European turbine cycle design, the IP turbine extraction steam will normally be routed to the first in-situ feedwater heater, for desuperheating, and then flow to an Exergetic Heater System; within the Exergetic Heater System first encountering a compressor device, and then an Exergetic Heater. In this embodiment, the Exergetic Heater is the final feedwater heater. As will be seen in the accompanying illustrations, for the typical European design (FIG. 1), the Exergetic Heater System is typically placed between the first and second of the in-situ feedwater heaters (feature 800 in FIG. 2); and where the third in-situ feedwater heater is eliminated from the system. For the typical North American design (FIG. 3), the Exergetic Heater System is placed either downstream from the first in-situ feedwater heater and before the steam generator (i.e., downstream from the top feedwater heater, 410, see feature 802 in FIG. 4A), or replaces the first in-situ feedwater heater and its turbine extraction routing (see feature 803 in FIG. 4B), or is placed between the first and second of the in-situ feedwater heaters (see feature 804 in FIG. 4C). Typically the output from the compressor device is routed to an Exergetic Heater acting as a final feedwater heater within 802 (see details in FIG. 5, FIG. 6, FIG. 7 and FIG. 8). However, as seen as feature 800 in FIG. 2, as seen as feature 804 in FIG. 4C which is detailed in FIG. 9, and as seen as feature 803 in FIG. 4B, the output from the compressor device is routed to the first feedwater heater in the feedwater path, it being the final feedwater heater. For FIG. 2 and FIG. 9, the compressor device receives steam from an Exergetic Heater. For FIG. 4B, the compressor device receives steam directly from the HP turbine extraction. The inlet conditions to the compressor device may require cooling, said cooling may be achieved using an additional heat exchanger, or through traditional attemperation employing spray water as shown by feature 721 in FIG. 2, in FIG. 4B, in FIG. 7 and in FIG. 9. For the purposes of describing this invention, all attemperation of fluid is accomplished using contact heating; i.e., direct mixing of fluids. For some of its embodiments, this invention teaches using a single turbine extraction to supply a plurality of condensing feedwater heaters, said heaters placed in series along the feedwater path, each heater operating by removing latent heat from the extraction steam made possible by use of a compressor device. An extraction from the IP turbine associated with a conventional fossil-fired Rankine cycle has an appropriate energy flow (given its reheating) for further feedwater heating, if such heating is accomplished using minimize extraction flow, provided the extraction pressure is increased. A series arrangement of heaters, with removal of latent heats, is possible given use of compressor devices whereby the pressure of the extraction steam is increased before it enters the shell-side of condensing heat exchangers. For another embodiment, this invention teaches to first desuperheat the IP turbine extraction steam, then compress it, and to then use it in a condensing feedwater heater. In this latter embodiment, a series of condensing feedwater heaters using the same extraction is not required.

The Exergetic Heater System is applicable to power plant designs found in both Europe and in North America. FIG. 2 illustrates an Exergetic Heater System incorporated into a typical European regenerative Rankine cycle of FIG. 1. FIG. 4A, FIG. 4B and FIG. 4C illustrate Exergetic Heater Systems incorporated into a typical North American regenerative Rankine cycle of FIG. 3. Broadly, the present invention teaches now to eliminate low final feedwater temperatures which may be associated with a regenerative Rankine cycle using minimum extraction steam. Further, the presence of an Exergetic Heater System divorces the power plant from inherent limitations on final feedwater temperature imposed by an un-modified regenerative Rankine cycle. Other advantages of the present invention will become apparent when its methods and apparatus are considered in conjunction with the accompanying drawings and discussions. Five embodiments of the Exergetic Heater System are disclosed to fully teach the invention.

A "compressor device" is broadly defined herein as a process through which the pressure of a "gaseous fluid" may be increased. Said gaseous fluid comprises water in a saturated state in which its quality is greater than zero, superheated steam, or steam in a super-critical state. Compressor devices comprise traditional devices and non-traditional devices. Traditional compressor devices are herein classed as either positive-displacement compressors, dynamic compressors or thermocompressors. Positive-displacement compressors comprise reciprocating-piston or rotary compressors. Reciprocating-piston compressors typically comprise single-acting, double-acting or diaphragm compressors. Rotary compressors typically comprise lobe, liquid ring, screw, scroll or vane compressors. There are a multitude of dynamic compressors, but generally classed as either centrifugal or axial compressors. Centrifugal compressors comprise: traditional centrifugal, blowers, and mixed-flow (diagonal) compressors. Axial compressors comprise: turbo-compressors, multistage axial compressors, spiral-axial compressors; etc.

Thermocompressors are essentially jet-pump devices, without moving parts, in which a high pressure motive fluid achieves a choked condition (achieved via a nozzle) and is used to increase the pressure of a supply fluid, through venturi affects achieved in a converging/diverging nozzle, resulting in a combined pressure higher than the pressure of the supply fluid. Although a wide variety of names may apply, in general the state of the motive fluid sets the description: if the motive fluid is steam the device is termed an ejector, or steam jet ejector; if the motive fluid is subcooled water, the device is termed an eductor, or water jet eductor. Both of these thermocompressors are applicable components in the Exergetic Heater System, the steam jet ejector having obvious applicability. The application of a water jet eductor is not obvious without modification, given its motive fluid is not a gaseous fluid. One such modification is discussed below, involving a reboiler. Thermocompressors employing motive steam are generally classed as being of critical or non-critical design, in reference to the flow of supply fluid through the device's throat. Of importance in selecting a thermocompressor employing motive steam is its compression ratio defined as the ratio of discharge pressure to suction pressure. For this invention, thermocompressors of the critical design are most applicable (i.e., achieving sonic velocities in the device's throat in which compression ratios >1.8). Of those thermocompressors employing motive steam, several types have applicability to this invention: 1) single nozzle thermocompressors which offer large compression ratios (i.e., critical), but at the expense of falling efficiencies with changes in motive steam pressure; 2) single nozzle spindle operated thermocompressors which offer high efficiency over a wide range of suction and discharge pressures, but at the expense of high motive steam flow; and 3) multi-nozzle thermocompressors which achieve steam savings of 10% to 15% when compared to single nozzle types designed for the same conditions, but at the expense of falling efficiencies with changes in motive steam pressure. If an Exergetic Heater System employs a thermocompressor, then the preferred embodiment is the use of a plurality of thermocompressors designed to selectively operator under varying motive steam and supply steam conditions.

Non-traditional compressor devices comprise micro-compressors and micro-electromechanical systems (MEMS) which increase the pressure of a gaseous fluid. Micro-compressors may be patterned after developed micro-turbines such as that described in U.S. Pat. No. 7,146,814; hereinafter '814. For compression of a gaseous fluid the invention of '814 may be run in reverse from that intended, converting a turbine into a compressor. As applied to the present invention, it would be obvious that a plurality '814-based compression devices would be required.

The compressor device most applicable for this invention is a turbo-compressor. As described below, controlling the inlet and outlet temperatures in a turbo-compressor may be necessary. Turbo-compressors are used in this invention to increase steam pressure; they are not intended to increase temperature. Any amount of attemperation using, for example, subcooled feedwater or condensate, or interstage cooling necessitated for equipment protection is assumed. However, since the thermocompressor has no moving parts its application to a power plant environment is also appealing. The disadvantage of the thermocompressor is that it requires motive steam. Such motive steam may be obtained from the main steam line feeding the Rankine cycle, but using such a source reduces electrical power. Another source of motive steam may be developed from feedwater, discussed below. Thermocompressors of the steam jet ejector type and adequate to supply the Exergetic Heater System comprise those manufactured by either Artisan Industries Inc. of Waltham, Mass. (info@ArtisanInd.com), or by Croll Reynolds Company of Parsippany, N.J. (SWCroll@Croll.com); there are other manufacturers. The Croll Reynolds Company manufactures multi-nozzle thermocompressors. Other compressor designs applicable for an Exergetic Heater System application will become apparent when all methods and apparatus of this invention are considered in conjunction with the accompanying drawings and discussions of several embodiments.

In one embodiment, the Exergetic Heater System comprises a thermocompressor and an Exergetic Heater, illustrated in FIG. 5. In this configuration of an Exergetic Heater System, the motive steam driving the thermocompressor is obtained from the steam generator. The source of motive steam may be any steam at a higher steam pressure than the pressure of the IP turbine extraction. For example, main steam may be used as motive steam. As another example, steam from the outlet of the "Primary Superheater" may be used as motive steam. The Primary Superheater is herein defined as the first working fluid heat exchanger downstream from the steam generator's drum or a point in the system where saturation is reached. Using Primary Superheater outlet steam has advantage in that it is superheated, has sufficient pressure to drive the thermocompressor, and has not consumed fuel normally required to heat the motive steam flow to main steam conditions thus minimizing power losses. The outlet from the thermocompressor is routed to the Exergetic Heater where its latent heat is transferred to the feedwater. Control of the final feedwater temperature is achieved through a control valve whose actuation adjusts the amount of steam flow being routed from the IP turbine to the Exergetic Heater System in combination with control of motive steam flow. The embodiment of FIG. 5 has the advantage of having no moving parts, thus system reliability is enhanced.

In another embodiment, the Exergetic Heater System comprises a reboiler, a thermocompressor and an Exergetic Heater, illustrated in FIG. 6. Feedwater, exiting from the last in-situ feedwater heater, is routed to a reboiler, this fluid being heated until at least saturation is reached; the resultant steam may then be combined with high pressure steam, this mixed steam is then used as motive steam in a thermocompressor to increase the pressure of IP turbine extraction steam to accomplish a heating of feedwater in the Exergetic Heater. The use of a reboiler, in combination with a thermocompressor, advantages both the high pressure associated with final feedwater, although subcooled, but then uses the vaporized feedwater to increase the IP turbine extraction pressure by acting as motive steam in a thermocompressor. If the motive steam was not vaporized, it would flash in the throat of the thermocompressor's nozzle, destroying venturi affects. In this embodiment the heating fluid for the reboiler is IP turbine extraction steam; upon exiting from the reboiler this steam (still superheated) enters the thermocompressor as supply steam. The advantage of this embodiment is that high pressure steam flow is further minimized, thus minimizing lost turbine shaft power. The embodiment of FIG. 6 employing a reboiler, thermocompressor and an Exergetic Heater assures that feedwater may be heated to its intended final temperature using less turbine steam than the embodiment illustrated in FIG. 5, provided the same source of steam is employed. The embodiment of FIG. 6 as taught herein and through FIG. 10 is the Preferred Embodiment.

In yet another embodiment, the Exergetic Heater System comprises a turbo-compressor and a single Exergetic Heater, illustrated in FIG. 7. In this embodiment the turbo-compressor is driven by an electric motor or by a steam-driven auxiliary turbine. It may be that the turbo-compressor has working fluid temperature limitations in which case the IP turbine extraction steam may be attemperated using subcooled feedwater. The outlet of the turbo-compressor is routed to the shell-side of the single Exergetic Heater where its latent heat is transferred to the feedwater. Control of the final feedwater temperature is achieved through a control valve whose actuation adjusts the amount of steam flow being routed from the IP turbine to the Exergetic Heater System in combination with control of the turbo-compressor. In this arrangement, the compressor device could be a positive-displacement compressor or a thermocompressor. The embodiment of FIG. 7 employing a turbo-compressor and a single Exergetic Heater assures that the feedwater may be heated to its intended final temperature using a minimum of turbine steam. Thus direct reduction of turbine shaft power is only associated with IP turbine extraction steam as required by the Exergetic Heater System; motive steam is not employed.

In yet another embodiment, the Exergetic Heater System comprises a desuperheating heat exchanger, a turbo-compressor and an Exergetic Heater, illustrated in FIG. 8. The heating of feedwater is accomplished by routing steam from the IP turbine extraction to the desuperheating heat exchanger which heats feedwater by partially desuperheating the steam. The exiting steam from the desuperheater is then routed to a turbo-compressor which increases its pressure. This higher pressure steam is then routed to an Exergetic Heater which further heats feedwater by extracting the steam's latent heat. The latent heat transfer is possible given the higher pressure achieved from the turbo-compressor. This combination of equipment comprising an Exergetic Heater System assures that the feedwater is properly heated to its intended final temperature, or beyond, using a minimum of turbine steam. The desuperheating heat exchanger has two functions: first, to heat the feedwater; and second, to reduce steam temperature to levels required by the typical turbo-compressor. Control of the final feedwater temperature is achieved through a control valve whose actuation adjusts the amount of steam flow being routed from the IP turbine to the Exergetic Heater System in combination with control and safeguards of the turbo-compressor. In this embodiment, the compressor device may well represent a plurality of turbo-compressors, the failure of one turbo-compressor, if so designed, would therefore not jeopardize the continuing operation of the Exergetic Heater System. The embodiment of FIG. 8 employing dual heat exchangers and a turbo-compressor assures that feedwater may be heated to its intended final temperature using less turbine steam than the embodiment illustrated in FIG. 7.

In yet another embodiment, applicable for regenerative Rankine cycles used in North American (FIG. 3), involves replacing the highest pressure extraction system (extraction line and feedwater heater) with an Exergetic Heater System. As seen in FIG. 4B, the Exergetic Heater System in this embodiment comprises a compressor device placed in the HP turbine's extraction line, its exhaust being routed to an Exergetic Heater acting as the final feedwater heater. The Exergetic Heater in this embodiment acts as a final feedwater heater in the same manner as the heater it replaces. This Exergetic Heater is considered part of this invention as it would require a higher thermal load (higher extraction flow) to adequately advantage the high exhaust pressure from the compressor device.

In yet another embodiment, applicable for regenerative Rankine cycles used in either Europe (FIG. 1) or North America (FIG. 3), involves placing an Exergetic Heater System between the first and second of the in-situ feedwater heaters, accompanied by the manipulation of extraction line routings. The Exergetic Heater System in this embodiment comprises an Exergetic Heater and a turbo-compressor, illustrated as feature 800 in FIG. 2, as seen as feature 804 in FIG. 4C which is detailed in FIG. 9. In this embodiment when applied to the European design (FIG. 2), the IP turbine extraction is re-routed from the first of the in-situ feedwater heaters, to an Exergetic Heater. Drain flow from the second of the in-situ feedwater heaters is routed to the DA. The third in-situ feedwater heater used in the typical European design is eliminated. Shell outlet flow from the Exergetic Heater is routed to a compressor device; exhaust from the compressor device is routed to a top feedwater heater (which may be the first of the in-situ feedwater heaters, if adequately designed). In this embodiment when applied to the North American design (FIG. 4C, detailed in FIG. 9), the IP turbine extraction is re-routed from the second of the in-situ feedwater heaters, to an Exergetic Heater. The High Pressure (HP) turbine extraction (i.e., HP exhaust) is re-routed from the first (top) in-situ feedwater heater, to the second of the in-situ feedwater heaters. As with the European manipulation as seen in FIG. 2, shell outlet flow from the Exergetic Heater is routed to a compressor device; exhaust from the compressor device is routed to the top feedwater heater. This embodiment maximizes gains to both thermal efficiency and turbine shaft power (e.g., electrical generation). In the previously described embodiments, IP turbine extraction steam was routed to an Exergetic Heater System in addition to its routine routing to an in-situ feedwater heater. Such employment of IP turbine extraction steam allowed a plurality of condensing feedwater heaters, placed in series along the feedwater path, to use the same source of extraction steam. Although there are individual advantages to each of the above embodiments, they all require additional IP turbine extraction steam flow to drive the Exergetic Heater System. In the embodiment of FIG. 2 and FIG. 9, the entire IP turbine extraction steam is routed directly to an Exergetic Heater System, and then to a turbo-compressor, and then to a final heating of feedwater. The use of this IP energy flow is possible only because the Exergetic Heater System is placed between the first two in-situ feedwater heaters. This placement allows a large Δtemperature rise across the Exergetic Heater (feature 400 in FIG. 2 and FIG. 9, whereas if placed downstream from the first in-situ feedwater heater, given its heating, only a small Δtemperature rise is possible. This embodiment allows any reasonable increase in final feedwater temperature; Δtemperature rises of 10 to 55 ΔF (5.6 to 30.6 ΔC) have been demonstrated through mass and energy balances. By adjusting (lowering) the pressure of the HP turbine exhaust steam entering the heater just upstream from the Exergetic Heater System, its shell saturation temperature is lowered, thus lowering the tube outlet temperature. In essence this allows control of the Δtemperature rise across the Exergetic Heater. Thus, with compressor affects, this ability allows control of conditions (pressure and enthalpy) entering the final feedwater heater. Mass and energy balances, discussed below teach through examples the operation of this embodiment. The embodiment of FIG. 2 and FIG. 9, employing an Exergetic Heater, a turbo-compressor and manipulation of extraction line routings, assures that feedwater may be heated to its intended final temperature, and considerably beyond if desired, using less turbine steam than any of the previously described embodiments as illustrated in FIG. 5, FIG. 6, FIG. 7 or FIG. 8.

BRIEF DESCRIPTION OF THE DRAWINGS

FIG. 5, FIG. 6, FIG. 7 and FIG. 8 detail embodiments of the Exergetic Heater System applicable for its placement shown in FIG. 4A.

FIG. 10 presents the feedwater portion of FIG. 4A, incorporating an Exergetic Heater System embodied by FIG. 5, comprising a thermocompressor and an Exergetic Heater. FIG. 10 employs main steam as motive steam to the thermocompressor.

FIG. 11 presents a mass and energy balance based on actual power plant data, illustrating the feedwater portion of FIG. 4A, incorporating an Exergetic Heater System embodied by FIG. 6, comprising a reboiler, a thermocompressor and an Exergetic Heater.

FIG. 12 presents a mass and energy balance based on actual power plant data, illustrating the feedwater portion of FIG. 4A, incorporating an Exergetic Heater System embodied by FIG. 7, comprising a turbo-compressor and an Exergetic Heater.

FIG. 13 presents a mass and energy balance based on actual power plant data, illustrating the feedwater portion of FIG. 4A, incorporating an Exergetic Heater System embodied by FIG. 8, comprising a desuperheater, a turbo-compressor and an Exergetic Heater.

FIG. 14 presents a mass and energy balance based on actual power plant data, illustrating the feedwater portion of FIG. 4B, incorporating an Exergetic Heater System, comprising a turbo-compressor and an Exergetic Heater.

FIG. 15 presents a mass and energy balance based on actual power plant data, illustrating the feedwater portion of FIG. 4C, incorporating an Exergetic Heater System embodied by FIG. 9, comprising an Exergetic Heater and a turbo-compressor.

DESCRIPTION OF THE PREFERRED EMBODIMENTS

Figure 1:
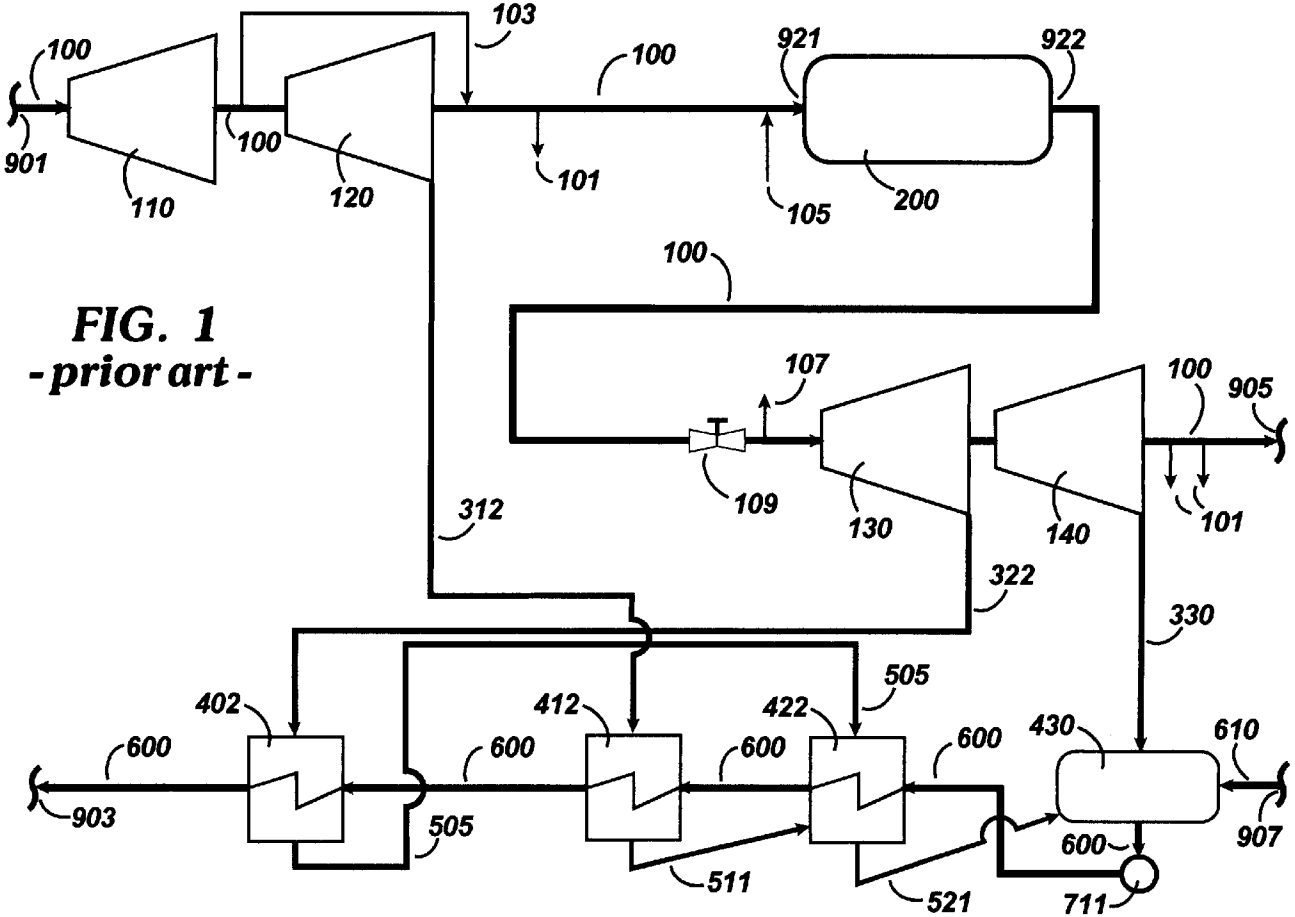
FIG. 1 illustrates a portion of a typical regenerative Rankine cycle of a typical design used in Europe, it is an example of prior art.

The teachings of the present invention are divided into three sections. The first section discusses the impact a degraded final feedwater temperature has on system thermal efficiency considering individual impacts on the regenerative Rankine cycle (i.e., turbine cycle efficiency) and on the steam generator (i.e., boiler efficiency). The first section contains definitions of variables. The second section discusses the impact of the IP turbine's flow passing ability and its affects on final feedwater temperature. These two sections are important as to how to properly control an Exergetic Heater System from a system's view-point. The third section teaches the implementation of the present invention, that is to correct effects on system thermal efficiency of degraded final feedwater temperature.

Final Feedwater Temperature

System thermal efficiency of a power plant employing a steam generator and a regenerative Rankine cycle may be affected by internal interface conditions (i.e., boundaries) between the regenerative Rankine cycle and the steam generator. The energy flow supplied to the regenerative Rankine cycle from the steam generator is termed the "Useful Energy Flow Supplied" ($\tau m\Delta h$). By a boundary condition is meant the fluid's pressure and temperature (or quality) and resulting enthalpy (h), and the fluid's mass flow (m). For any power plant, system (or "unit") thermal efficiency is given by:

$$\eta_{Unit}=\eta_{TC}\eta_B \tag{1}$$

The efficiency of the regenerative Rankine cycle (also termed turbine cycle efficiency) is given as:

$$\eta_{TC}=P/\Sigma m\Delta h \tag{2}$$

Boiler efficiency may be expressed traditionally by Eq. (3), noting it employs a higher (gross) heating value as commonly used in North America. In Europe the lower (net) heating value (LHV) is used to define boiler efficiency. Use of HHV or LHV is not material to the present invention, either may be employed if used consistently as in Eqs. (3), (4B), (4C), etc.

$$\eta_B=\Sigma m\Delta h/(m_{AF}\mathrm{HHV}) \tag{3}$$

Substitution of these equations leads to Eq. (4C), a classical definition of system thermal efficiency of useful power output divided by input energy flow:

$$\eta_{Unit}=[P/\Sigma m\Delta h]\eta_B \tag{4A}$$

$$\eta_{Unit}=\eta_{TC}[\Sigma m\Delta h/(m_{AF}\mathrm{HHV})] \tag{4B}$$

$$\eta_{Unit}=P/(m_{AF}\mathrm{HHV}) \tag{4C}$$

In the above equations, and elsewhere herein:

$\eta_{Unit}$=System (unit) thermal efficiency, unitless; note that "heat rate" commonly used in the power industry is defined as $3412.1416/\eta_{Unit}$ for Btu/kWh units of measure (or $3600.0/\eta_{Unit}$ for kJ/kWh units of measure);

$\eta_B$=Steam generator (boiler) efficiency, unitless;

$\eta_{TC}$=Thermal efficiency of the regenerative Rankine cycle (turbine cycle), unitless;

$\Sigma m\Delta h$="Useful Energy Flow Supplied" to the working fluid from the steam generator, Σmass flow (m) times specific enthalpy changes (Δh), Btu/hr (kJ/hr). For a typical regenerative Rankine cycle used in a power plant, the term ΣmΔh may be defined by the following quantities:

$$\Sigma m\Delta h = m_{FW}(h_{Throttle} - h_{Final\text{-}FW}) + m_{RH}(h_{HRH} - h_{CRH}) \quad (5)$$

$h_{Throttle}$=Specific enthalpy from the steam generator delivered at the turbine cycle's boundary (i.e., the Throttle Valve located immediately upstream from the HP turbine), Btu/lbm (kJ/kg);

$h_{Final\text{-}FW}$=Specific enthalpy of the final feedwater delivered to the steam generator, Btu/lbm (kJ/kg);

$m_{FW}$=Final feedwater flow, lbm/hr (kg/hr);

$m_{RH}$=Reheat flow, lbm/hr (kg/hr);

$h_{HRH}$=Specific enthalpy from the steam generator delivered at the turbine cycle's boundary (i.e., the Intercept Valve located immediately upstream from the IP turbine, termed "Hot Reheat"), Btu/lbm (kJ/kg);

$h_{CRH}$=Specific enthalpy from the HP turbine's exhaust (termed "Cold Reheat") as routed to the steam generator, Btu/lbm (kJ/kg);

HHV=Higher heating value of the As-Fired fuel, also termed gross heating value or gross calorific value, Btu/lbm (kJ/kg);

LHV=Lower heating value of the As-Fired fuel, also termed net heating value or net calorific value, Btu/lbm (kJ/kg);

$m_{AF}$=As-Fired (actual) fuel flow to the steam generator, lbm/hr (kg/hour);

P=Useful power output from the system as thermal or electrical power (e.g., gross electrical generation or gross shaft power), Btu/hr (kJ/hour);

$T_{Final\text{-}FW}$=Final feedwater temperature, ° F. (° C.).

By examining these terms it becomes obvious that when the Useful Energy Flow Supplied (ΣmΔh) becomes degraded (i.e., increases for a constant power output), that turbine cycle efficiency ($\eta_{TC}$) will decrease. Increases (degradation) in ΣmΔh may occur through changes to any term of Eq. (5); ΣmΔh will increase given a decrease in the final feedwater enthalpy, $h_{Final\text{-}FW}$, given a decrease in the final feedwater temperature, $T_{Final\text{-}FW}$.

To more fully understand the relationship between system, turbine cycle and boiler efficiencies, propose that a change in turbine cycle efficiency is exactly off-set by an opposing change in boiler efficiency; thus no change in system thermal efficiency. However, if assuming constant power, a change in turbine cycle efficiency means a change in the Useful Energy Flow Supplied (ΣmΔh). Indeed, since ΣmΔh appears in the numerator of turbine cycle efficiency and in the denominator of boiler efficiency, effects might cancel. But if affects on $\eta_{TC}$ at constant power are to be just off-set by $\eta_B$, then fuel energy flow must remain constant. However, thermodynamics suggests this can not be the case; system thermal efficiency must change. The conundrum is that any change in ΣmΔh will integrally affect the steam generator's fuel energy flow, $m_{AF}$-HHV. The relationship between these two energy flows, which is boiler efficiency of Eq. (3), is not dependent on rigid linearity between turbine cycle efficiency and ΣmΔh (given constant power). Indeed, for a steam generator the relationship between ΣmΔh and $m_{AF}$HHV is non-linear for the following reasons. First, the fluids employed in a steam generator have completely different Maxwellian relationships. An incremental change in $(\partial h/\partial P)_T$ for water is not that for its heating medium the combustion gas if heating working fluid from fossil fuel. Thus an incremental change in Carnot conversion of a change in water's ΣmΔh to ideal work is not that associated with an incremental change its instigating fuel. For example, a change in $h_{Final\text{-}FW}$ must affect the Economizer's exiting combustion gas in a conventional power plant (the first exchanger encountered in the steam generator) in a non-linear manner. This will have non-linear effects on the exit boundary conditions of the steam generator, and thus on boiler efficiency. Second, a differential change in thermal energy, ∂(ΣmΔh), must result in a different differential change in chemical energy, $\partial(m_{AF}\text{HHV})$. Again, to invoke Maxwell relationships, $(\partial h/\partial P)_T$ for water varies with operating temperature, $(\partial h/\partial P)_T$ for a fossil fuel is essentially constant. To state otherwise would suggest the ratio of $(\partial h/\partial P)_T$ between water and a fossil fuel is constant, leading to a linear relationship between boiler efficiency and load. There is no known fossil-fired steam generator having such characteristics.

If ΣmΔh increases by 2% given a decrease in $h_{Final\text{-}FW}$, at constant power, turbine cycle efficiency will decrease by 2%. If boiler efficiency has been found to change due to a 2% change in ΣmΔh, then $m_{AF}$HHV will change by something other than 2%. Thus system thermal efficiency will have changed.

Second Law concepts produce a systems view. One approach is to differentiate Eq. (1) by power (or exergy); see Eqs. (6B) & (6C). For this and the following paragraph, the indicated partial derivatives are based on holding environmental factors constant. Allow power its variability. The result indicates if fuel energy flow is increased resulting in a higher power output, as converted by a system thermal efficiency, that the governing term $[\eta_{Unit}\partial(m_{AF}\text{HHV})/\partial P]$ must then be less than unity to produce an increase in system thermal efficiency (i.e., $\partial\eta_{Unit}/\partial P>0.0$).

$$\partial\eta_{Unit}/\partial P = \partial(\eta_{TC}\eta_B)/\partial P \quad (6A)$$

$$\partial\eta_{Unit}/\partial P = \{1.0 - \eta_{Unit}\partial(m_{AF}\text{HHV})/\partial P\}/(m_{AF}\text{HHV}) \quad (6B)$$

$$\partial\eta_{Unit}/\partial P = \{1.0 - [\partial(m_{AF}\text{HHV})/m_{AF}\text{HHV}]/[\partial P/P]\}/(m_{AF}\text{HHV}) \quad (6C)$$

The governing term in Eq. (6C) being less than unity to achieve an improved system thermal efficiency, implies a most unusual case where a relative increase in fuel energy flow leads to an even larger relative increase in power output. In summary, a relative increase in fuel energy flow with a concomitant increase in power, caused for example by a change in $h_{Final\text{-}FW}$, will not improve system thermal efficiency unless $[\eta_{Unit}\partial(m_{AF}\text{HHV})/\partial P]<1.0$.

Another and more direct approach is to differentiate Eq. (1) by the Useful Energy Flow Supplied (ΣmΔh). The result of Eq. (8), following from Eq. (7B) where power is held constant, ∂P=0.0, indicates that when an increase in ΣmΔh results in an increase in fuel energy flow, thus $[\partial(m_{AF}\text{HHV})/\partial(\Sigma m\Delta h)]>0.0$, that system thermal efficiency will always decline.

$$\partial\eta_{Unit}/\partial(\Sigma m\Delta h) = \partial(\eta_{TC}\eta_B)/\partial(\Sigma m\Delta h) \quad (7A)$$

$$\partial\eta_{Unit}/\partial(\Sigma m\Delta h) = [\partial P/\partial(\Sigma m\Delta h) - \eta_{Unit}\partial(m_{AF}\text{HHV})/\partial(\Sigma m\Delta h)]/(m_{AF}\text{HHV}) \quad (7B)$$

$$[\partial\eta_{Unit}/\partial(\Sigma m\Delta h)]_P = -\eta_{Unit}[\partial(m_{AF}\text{HHV})/\partial(\Sigma m\Delta h)]_P/(m_{AF}\text{HHV}) \quad (8)$$

Eq. (8) also suggests that if an increase of any magnitude in ΣmΔh results in a decrease in fuel energy flow, that system thermal efficiency will improve provided power output is held constant. This would suggest, to demonstrate in the extreme, that a 20% increase in ΣmΔh could result in less fuel consumed! Again, invoking the arguments made above, such a situation will lower $\eta_{TC}$, and, if $\eta_{Unit}$ is to be improved, means a ≧20% improvement in boiler efficiency! This observation teaches as applied thermodynamics, that no improvement in system thermal efficiency may be expected from any increase in $\Sigma m\Delta h$, no matter how small, provided power is held constant. Thus the issue reduces, given a perturbation in the turbine cycle, to understanding changes in boiler efficiency, Eq. (3). Any in-situ thermal system, operating with a defined and constant environment, will convert a relative change in its fuel energy flow, $\Delta(\Sigma m\Delta h)/\Sigma m\Delta h$, to a relative thermal output by a continuous boiler efficiency function. To do otherwise would violate Carnot's teachings. It would suggest that a Carnot conversion of thermal energy flow to ideal shaft power is discontinuous, different incrementally for a given $\partial(m_{AF}\text{HHV})$ change. On the other hand, if it is proposed that both power output (P) and fuel energy flow ($m_{AF}$HHV) remain constant, but $\Sigma m\Delta h$ varies, then Eq. (4C) would then suggest system thermal efficiency is constant. Under this proposal, any change to $\Sigma m\Delta h$ would be exactly off-set by a counter-acting change in boiler efficiency, see Eq. (4A); but which must imply an off-setting change in the system's fuel energy flow ($m_{AF}$HHV). Thus, again, it is impossible to envision a change in $\Sigma m\Delta h$ without affecting boiler efficiency. It is impossible to envision a negative value for $[\partial(m_{AF}\text{HHV})/\partial(\Sigma m\Delta h)]$ given constant system power production.

In summary, although a degraded final feedwater temperature may not always degrade boiler efficiency ($\eta_B$), if such a degradation in final feedwater temperature results in an increase in fuel energy flow (even with an increase in boiler efficiency), system thermal efficiency will always decline. The impact on boiler efficiency will be non-linear when compared to its impact on turbine cycle efficiency. For a fossil-fired system, a degraded final feedwater temperature may result in a lower combustion gas boundary temperature (i.e., Stack temperature); this would result, all other conditions remaining constant, in an improved boiler efficiency and lower fuel flow. However, a reduced Stack temperature will upset conditions elsewhere in the system given affects on downstream working fluid and associated combustion gas conditions. Examples of this may include: a reduced temperature inlet to the IP turbine; a readjustment of spray flows controlling HP and IP turbine inlet conditions, changes in economizer outlet conditions, etc. Whatever the cycle complexities, a degraded final feedwater temperature may easily result in a lower system thermal efficiency. It becomes necessary then, when fully implementing the present invention, to use automatic controls to determine turbine cycle and boiler efficiencies in real-time. Boiler efficiency must be determined independent of fuel flow for coal-fired units given the uncertainties found in metering coal flow.

For fossil-fired steam generators, the determination of boiler efficiency is considered established art. Any of the following procedures may be employed to determine boiler efficiency as required to support the full teachings of the present invention: the Input/Loss Method of computing boiler efficiency as taught in U.S. Pat. No. 6,584,429 (hereinafter referred to as the "Input/Loss Method"); the method taught by the American Society of Mechanical Engineers, Performance Test Code 4 (hereinafter referred to as the "ASME PTC 4 Method"); the method taught by the American Society of Mechanical Engineers, Performance Test Code 4.1 (hereinafter referred to as the "ASME PTC 4.1 Method"); methods taught by the German standard "Acceptance Testing of Steam Generators", DIN 1942, DIN DEUTSCHES Institut Fur Normung E. V. (hereinafter referred to as the "DIN 1942 Method"); the Shinskey control method as referenced in F. G. Shinskey, Energy Conservation Through Control, Academic Press, 1978, pages 102-104 and similar real-time control oriented methods (hereinafter collectively referred to as the "Control-Oriented Method"); methods employed by a power plant's distributed control system (or DCS, hereinafter referred to as the "DCS-Based Method"). DCS-Based Methods include those provided by the following: ABB Utilities of Mannhiem, Germany and its subsidiaries & affiliated companies; Siemens of Munich, Germany and its subsidiaries & affiliated companies; ALSTOM of Baden, Switzerland and its subsidiaries & affiliated companies; Emerson Electric Company of St. Louis, Mo. and its subsidiaries & affiliated companies; and similar distributed control systems. In addition, the determination of boiler efficiency as required to support the full teachings of the present invention include any other reputable method of computing boiler efficiency. The preferred embodiment for computing boiler efficiency as applicable to a fossil-fired steam generator is the Input/Loss Method.

Flow Passing Ability and the IP Turbine

The causes of a decrease in the final feedwater enthalpy, $h_{Final\text{-}FW}$, thus degrading $\Sigma m\Delta h$, may occur through any one or all of the following: non-condensable gas blanketing of the heat transfer surface area (i.e., improper venting); unusual increase in the extraction line pressure drop; liquid level control problems in the heater's drain section; changes in extraneous (non-extraction) steam entering the heater; and erosion of the IP inlet nozzles. Of these reasons for degradation, all but erosion of the IP inlet nozzles may be repaired while on-line or their effects eliminated through operational changes. The most common reason for long-term decline in system thermal efficiency associated with turbine cycle boundary conditions is degradation in the final feedwater temperature as caused by erosion of the IP turbine's inlet nozzles.

The design steam mass flow passing through a turbine's nozzle is a function of the turbine's design characteristics: nozzle area, nozzle inlet steam pressure and specific volume, design mass flow rate, etc. From these considerations its design Flow Passing Ability constant ($K_{Design}$) may be determined using Eq. (9). In Europe the Flow Passing Ability constant is termed the turbine's Swallowing Capacity. Using $K_{Design}$, and assuming a constant nozzle area, the actual inlet mass flow at actual conditions may then be computed from Eq. (10).

$$K_{Design}=m_{B\text{-}Design}\sqrt{(P/v)_{B\text{-}Design}} \tag{9}$$

$$m_{B\text{-}Calc}=K_{Design}\sqrt{(P/v)_{B\text{-}Act}} \tag{10}$$

$$P_{B\text{-}Calc}=(m_{B\text{-}Act}/K_{Design})^2 v_{B\text{-}Calc}|_{h=f(P,T)} \tag{11}$$

where in these equations, and as used below:

$M_{B\text{-}Act}$=Actual mass flow at the turbine's inlet (termed its "Bowl"), an obtained inlet flow, lbm/hr (kg/hr)

$m_{B\text{-}Calc}$=Calculated mass flow at the turbine's inlet consistent with $K_{Design}$, lbm/hr (kg/hr)=

$m_{B\text{-}Design}$=Design mass flow at the turbine's inlet, lbm/hr (kg/hr)

$K_{Actual}$=Calculated Flow Passing Ability constant based on actual pressure, specific volume and obtained inlet flow conditions.

$K_{Design}$=Flow Passing Ability constant obtained from design conditions, that is determined, Eq. (9), using the turbine's design flow, design pressure and design specific volume associated with a chosen location (as at the inlet to a turbine stage group).

$P_{B\text{-}Act}$=Actual pressure inlet (Bowl) to a turbine stage group, psiA (barA)

$P_{B\text{-}Calc}$=Calculated pressure inlet (Bowl) to a turbine stage group, determined by iteration at constant enthalpy, see Eq. (11), psiA (barA)

$P_{B\text{-}Design}$=Design pressure inlet (Bowl) to a turbine stage group, psiA (barA)

$T_{B\text{-}Act}$=Actual temperature inlet (Bowl) to a turbine stage group, ° F. (° C.).

$T_{B\text{-}Design}$=Design temperature inlet (Bowl) to a turbine stage group, ° F. (° C.).

$v_{B\text{-}Act}$=Actual specific volume inlet (Bowl) to a turbine stage group, $ft^3$/lbm ($m^3$/kg)=f($P_{B\text{-}Act}$, $T_{B\text{-}Act}$)

$v_{B\text{-}Design}$=Design specific volume inlet (Bowl) to a turbine stage group, $ft^3$/lbm ($m^3$/kg)=f($P_{B\text{-}Design}$, $T_{B\text{-}Design}$)

$v_{B\text{-}Calc}$=Calculated specific volume inlet (Bowl) to a turbine stage group determined by iteration at constant enthalpy, see Eq. (11) and discussion below, $ft^3$/lbm ($m^3$/kg).

As the IP turbine's inlet nozzles erode and/or otherwise age, degradation (an increase) in its actual Flow Passing Ability may be monitored by measuring the inlet pressure and temperature, and then computing the turbine's inlet mass flow rate, $M_{B\text{-}Calc}$, via Eq. (10). Differences between $m_{B\text{-}Cal}$ and $M_{B\text{-}Design}$, or between $m_{B\text{-}Calc}$ and $M_{B\text{-}Act}$, are indicative of nozzle erosion. $m_{B\text{-}Act}$ may be determined by performing a mass balance on the turbine cycle from a point where the working fluid's flow is measured, to the IP turbine's inlet. If computing a mass balance to resolve $m_{B\text{-}Act}$, account must be made for the turbine steam path flow losses, e.g., turbine seal flows, extraction flows, and the like; and also account must be made for flow gains such as attemperation flows (i.e., in-flows used to control steam temperatures), and the like. However for monitoring purposes such determinations may bear considerable error due to uncertainties in $m_{B\text{-}Design}$ when comparing to the actual power output, or in the determination of $m_{B\text{-}Act}$.

Alternatively, the power plant engineer may assume a $m_{B\text{-}Act}$ value at design flow, or employ a constant fraction of the routinely measured feedwater flow and compute $P_{B\text{-}Calc}$ using Eq. (11). $P_{B\text{-}Calc}$ is then compared to the measured pressure $P_{B\text{-}Act}$; if $P_{B\text{-}Act}<P_{B\text{-}Calc}$ for a given power, the nozzle is eroded. Eq. (11) is deceptively complex in that an iterative procedure is require for solution. Each iteration made at an assumed constant enthalpy. Such a iterative procedure is available from Exergetic Systems, Inc. of San Rafael, Calif. (web site at www.ExergeticSystems.com) through its EX-PROP computer program; in 2005 EX-PROP was licensed for $350. The procedure involves plotting turbine data on a Mollier Diagram but ignoring turbine inlet data (which might be influenced by nozzle erosion), extrapolating the expansion line upwards to an assumed IP Bowl condition, choosing an enthalpy ($h_{B\text{-}Act}$) which crosses the extrapolated expansion line near the Bowl, then use EX-PROP to resolve $P_{B\text{-}Act}$ at the chosen enthalpy. This process is repeated until the state point ($P_{B\text{-}Act}$, $T_{B\text{-}Act}$ and $h_{B\text{-}Act}$) lies on the extrapolated expansion line thus satisfying the design Flow Passing Ability at the turbine's inlet mass flow, $m_{B\text{-}Act}$ as determined.

Alternatively, as an IP turbine's inlet nozzles erode and/or otherwise ages, its actual Flow Passing Ability, $K_{Actual}$, may be determined through measurement of the actual inlet pressure, the actual inlet temperature, and an obtained inlet mass flow, $m_{B\text{-}Act}$.

$$K_{Actual}=m_{B\text{-}Act}/\sqrt{(P/v)_{B\text{-}Act}} \tag{12}$$

Given nozzle degradation, the actual Flow Passing Ability constant, $K_{Actual}$ will generally indicate marked sensitivity when compared to the design value, $K_{Design}$. The obtained inlet mass flow may be had as discussed above. When degraded: $K_{Actual}>K_{design}$. This method is the preferred embodiment given greater observed sensitivity.

Implementation

To implement the present invention, an Exergetic Heater System is placed in the feedwater path of a regenerative Rankine cycle. To heat the feedwater, the Exergetic Heater System is supplied steam from a turbine extraction. The Exergetic Heater System consists of an Exergetic Heater and a compressor device. The turbine extraction steam, typically obtained from an IP turbine, is both compressed (increasing its pressure) and heated within the Exergetic Heater System. The compressor device and Exergetic Heater are an integral portion of the Exergetic Heater System. The Exergetic Heater carries feedwater within its tubes, heating it by cooling shell-side turbine extraction steam. Temperature control of the feedwater exiting the regenerative Rankine cycle is achieved through control valves placed on the turbine extraction steam lines and by governing the performance of the compressor device. Given an appropriate selection of the compressor device, the Exergetic Heater System should operate essentially independent of the power plant's load. In the ideal, the Exergetic Heater System is capable of maintaining a high final feedwater temperature which is independent of power plant load (i.e., independent of turbine steam path pressure).

In addition to the above paragraph, if a turbo-compressor is used as a compressor device, commonly the temperature of its supply steam must be limited to a maximum operating temperature. This situation is addressed through use of an attemperation device shown as feature 721 seen in FIG. 2, FIG. 7, and FIG. 9 whose cooling spray flow is obtained from the system's boiler feedwater pump, feature 540. The 721 attemperator is a contact type heat exchanger in which its supply and spray flows are mixed, thereby achieving a desired temperature. Turbo-compressors will generally have steam temperature limitations, for example the Siemens Model STC-SX is limited to 662° F. (350° C.). Another method to address such limitations, and to additionally assist in heating feedwater, two heat exchangers are employed: a desuperheating heat exchanger (feature 401 of FIG. 8) which reduces IP turbine extraction steam temperature to acceptable levels; and an Exergetic Heater (feature 400 of FIG. 8 and elsewhere) which, in the embodiments placing the Exergetic Heater System downstream from the first of the in-situ feedwater heaters, then condenses the IP turbine extraction steam. For embodiments where the Exergetic Heater System is placed between the first and second of the in-situ feedwater heaters, control of the temperature inlet to the turbo-compressor is achieved by altering the condensing pressure of the heater just upstream from the Exergetic Heater System; see feature 412 in FIG. 2, and feature 420 in FIG. 9.

Figure 2:
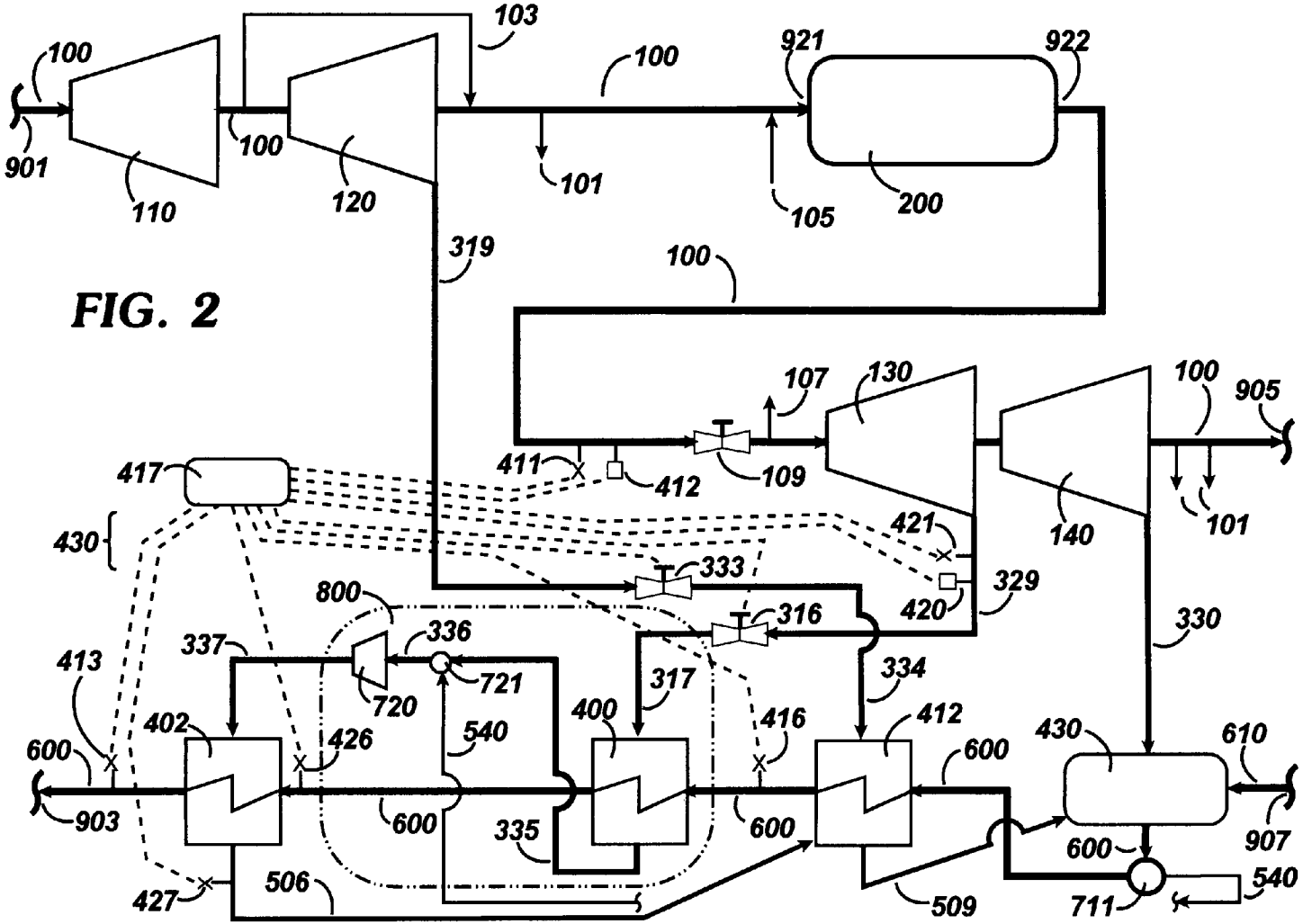
FIG. 2 illustrates the same portion of the regenerative Rankine cycle as shown in FIG. 1, but modified with an Exergetic Heater System in which a controller and associated instrumentation are shown, which achieves the advantages of the present invention.
Figure 3:
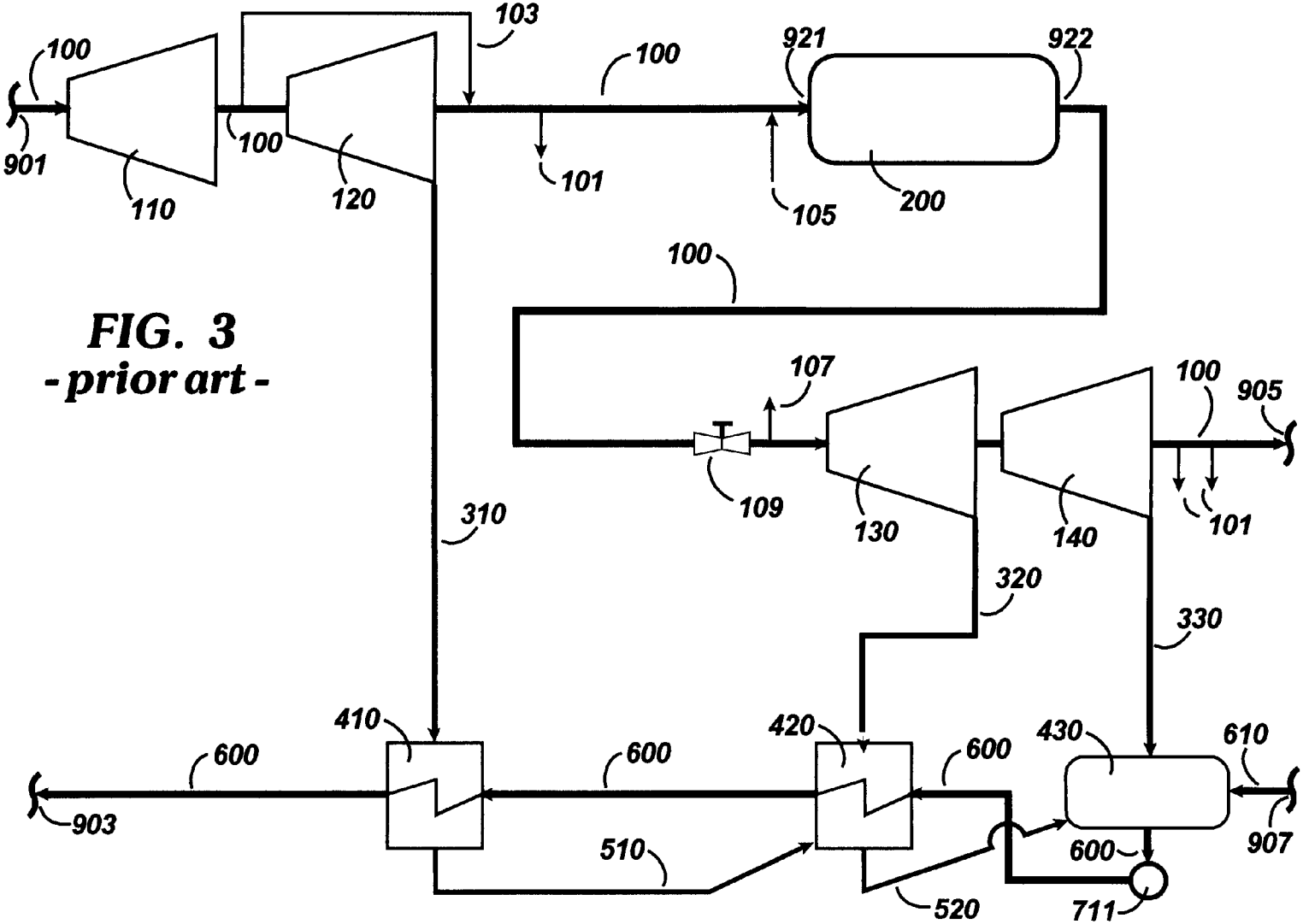
FIG. 3 illustrates a portion of a typical regenerative Rankine cycle of conventional design commonly used in North America, it is an example of prior art.
Figure 4A:
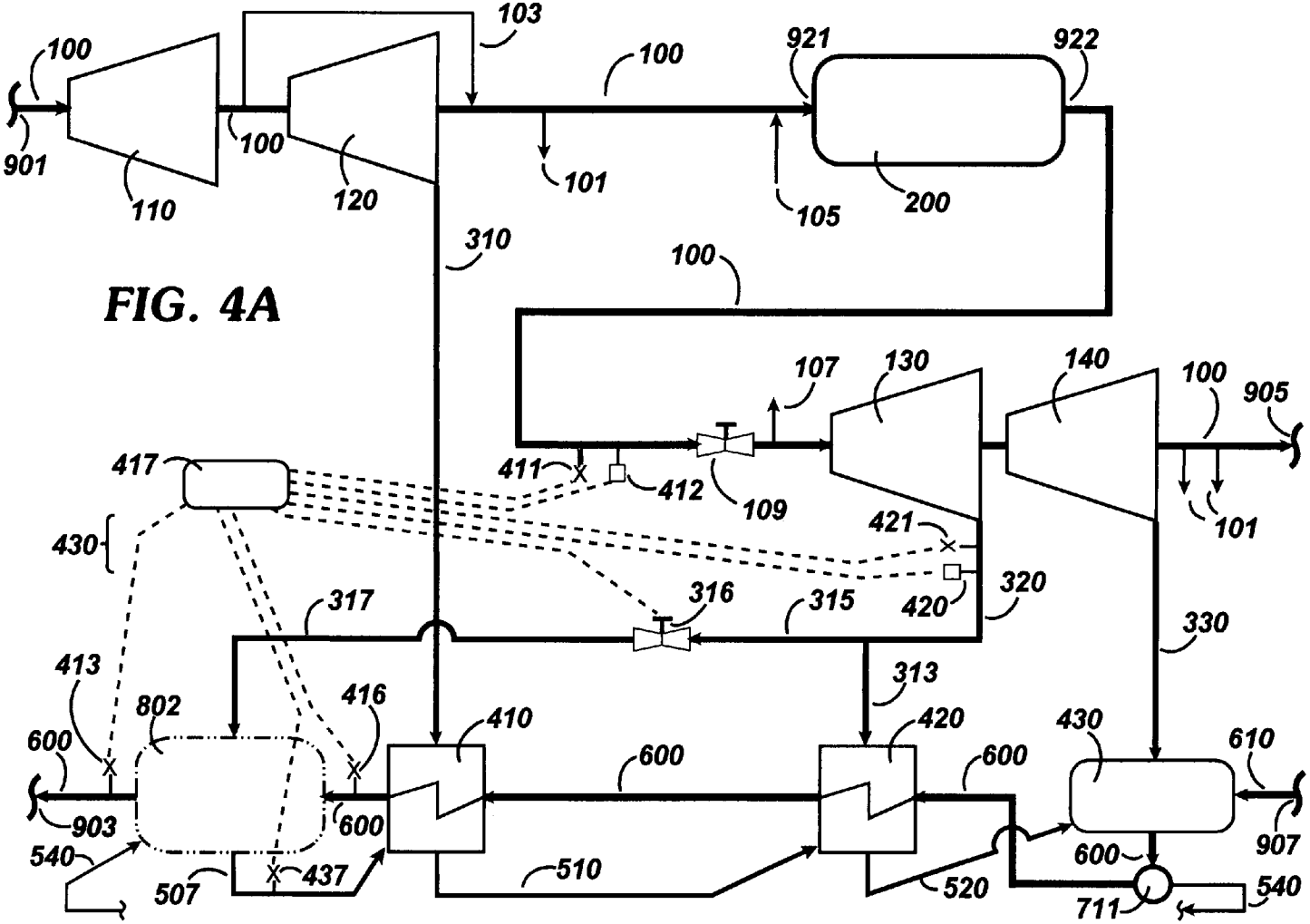
FIG. 4A illustrates the same portion of the regenerative Rankine cycle as shown in FIG. 3, but modified with an Exergetic Heater System placed downstream from the first in-situ feedwater heater, in which a controller and associated instrumentation are shown, which achieves the advantages of the present invention.
Figure 4B:
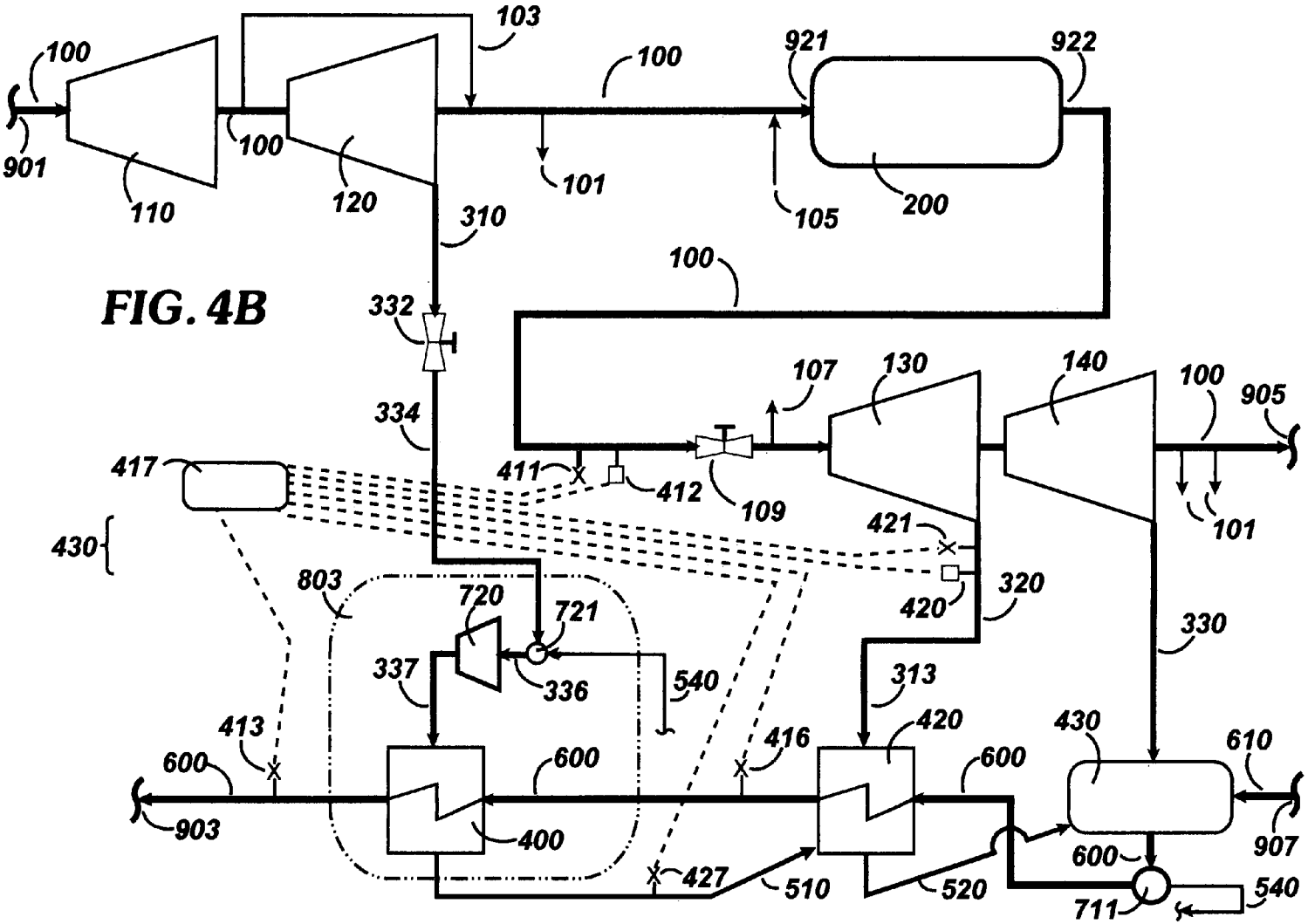
FIG. 4B illustrates the same portion of the regenerative Rankine cycle as shown in FIG. 3, but modified with an Exergetic Heater System which replaces the top heater and its extraction line, in which a controller and associated instrumentation are shown, which achieves the advantages of the present invention.
Figure 4C:
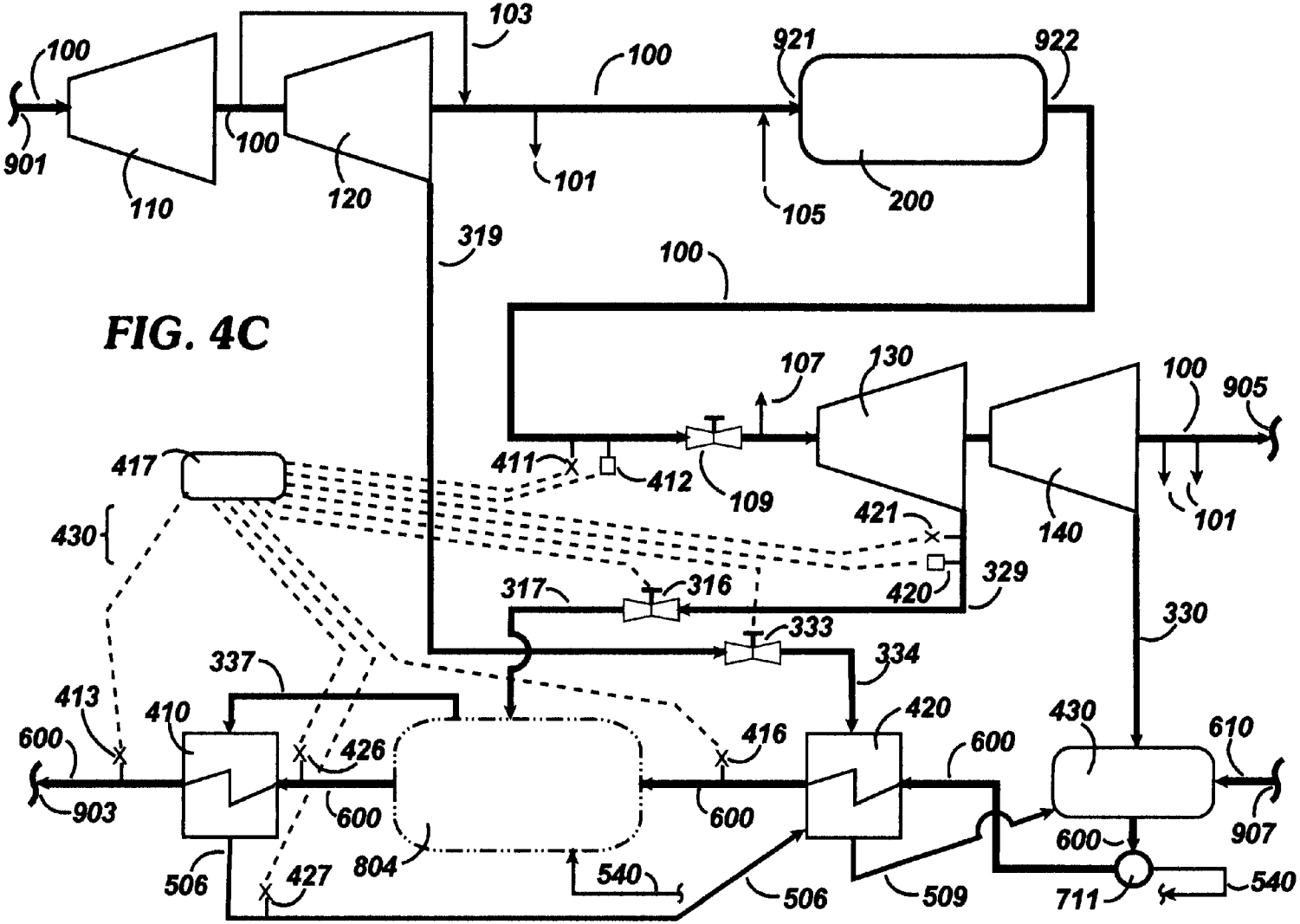
FIG. 4C illustrates the same portion of the regenerative Rankine cycle as shown in FIG. 3, but modified with an Exergetic Heater System placed upstream from the first in-situ feedwater heater, in which a controller and associated instrumentation are shown, which achieves the advantages of the present invention.

When FIG. 1 is compared to FIG. 2, it becomes evident how the present invention may be implemented for the typical European power plant. When FIG. 3 is compared to FIG. 4A, in combination with FIG. 5, FIG. 6, FIG. 7 and FIG. 8, it becomes evident how the present invention may be implemented for the typical North American power plant. Also, when FIG. 3 is compared to FIG. 4B, or FIG. 4C in combination with FIG. 9, it becomes evident how the present invention may be implemented for the typical North American power plant. As seen in FIG. 2 and in FIG. 4C (detailed in FIG. 9), the Exergetic Heater System is placed between the first and second of the in-situ feedwater heaters. As seen in FIG. 4A, the placement of the Exergetic Heater System is downstream from the last of the system's original in-situ feedwater heaters, and before the steam generator's first heat exchanger (typically the Economizer for a fossil fueled system). Use of IP turbine extraction steam is warranted for its high temperature, and, in the Preferred Embodiment, from a mid-point IP turbine extraction as shown in FIG. 2, FIG. 4A and FIG. 4C. Use of the highest practical extraction temperature is needed to heat the feedwater using minimum extraction flow. However, this, again, does not limit the invention as FIG. 4B illustrates an embodiment which compresses HP turbine extraction steam directly, and does not use IP steam. Generically, the use of a compressor device solves the problem of an extraction steam having low pressure as said steam is employed to increase the final feedwater temperature. Said extraction steam is derived from either the HP or IP turbine (including there exhaust extractions). Compressing LP turbine extraction steam is not part of this invention as such compression would not affect the final feedwater temperature. It is required, and accomplished by operation of the compressor device, that the final feedwater heating results in a condensed fluid (a subcooled state), its latent heat having been removed. This requirement is quite unique to the common European design in which its first feedwater heater (feature 402 in FIG. 1) produces superheated shell flow. Drain flows from the final feedwater heater, being condensed fluid, are routed to the drain section of a lower pressure feedwater heater, again possible because of increased pressure effected by the compressor device. For the European design, this design advantage means that an in-situ feedwater heater may be eliminated from the system; e.g., feature 422 in FIG. 1.

Figure 9:
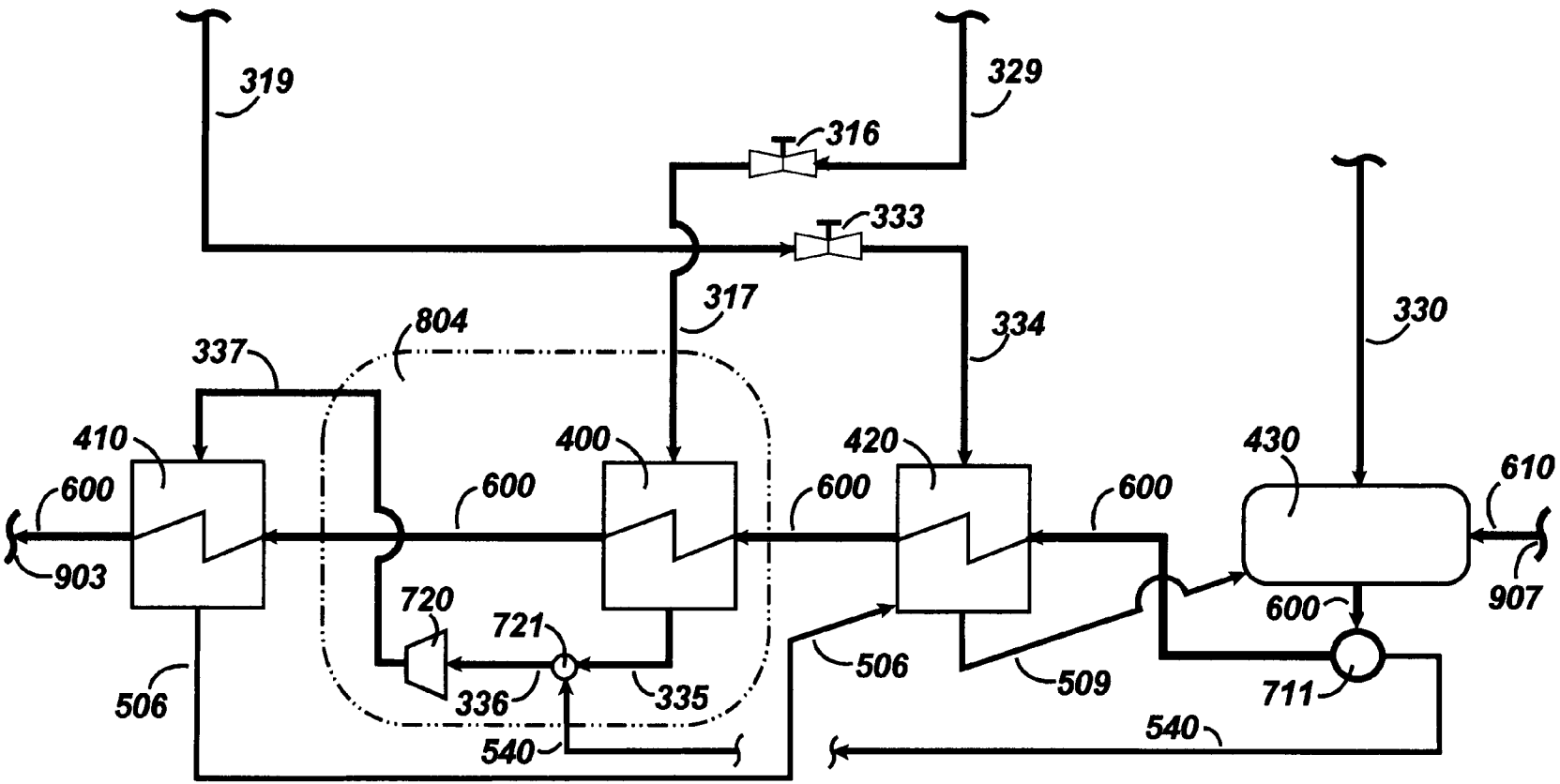
FIG. 9 details another embodiment of the Exergetic Heater System applicable for its placement shown in FIG. 4C. The embodiment of the Exergetic Heater System of FIG. 9 is the same is seen in FIG. 2.
Figure 10:
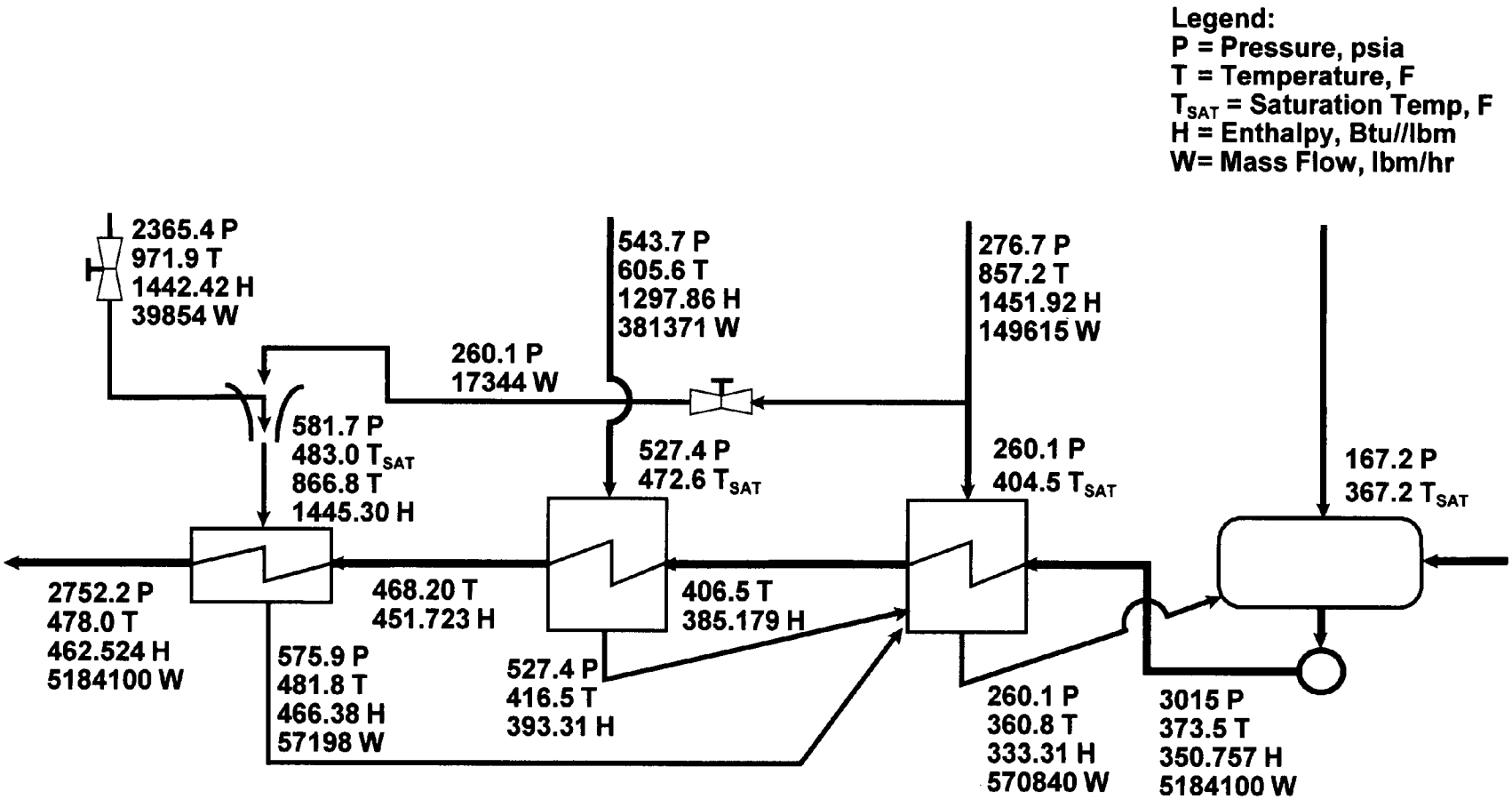
FIG. 10, FIG. 11, FIG. 12, FIG. 13, FIG. 14 and FIG. 15 teach the application of the invention through mass and energy balances based on actual power plant data.
Figure 11:
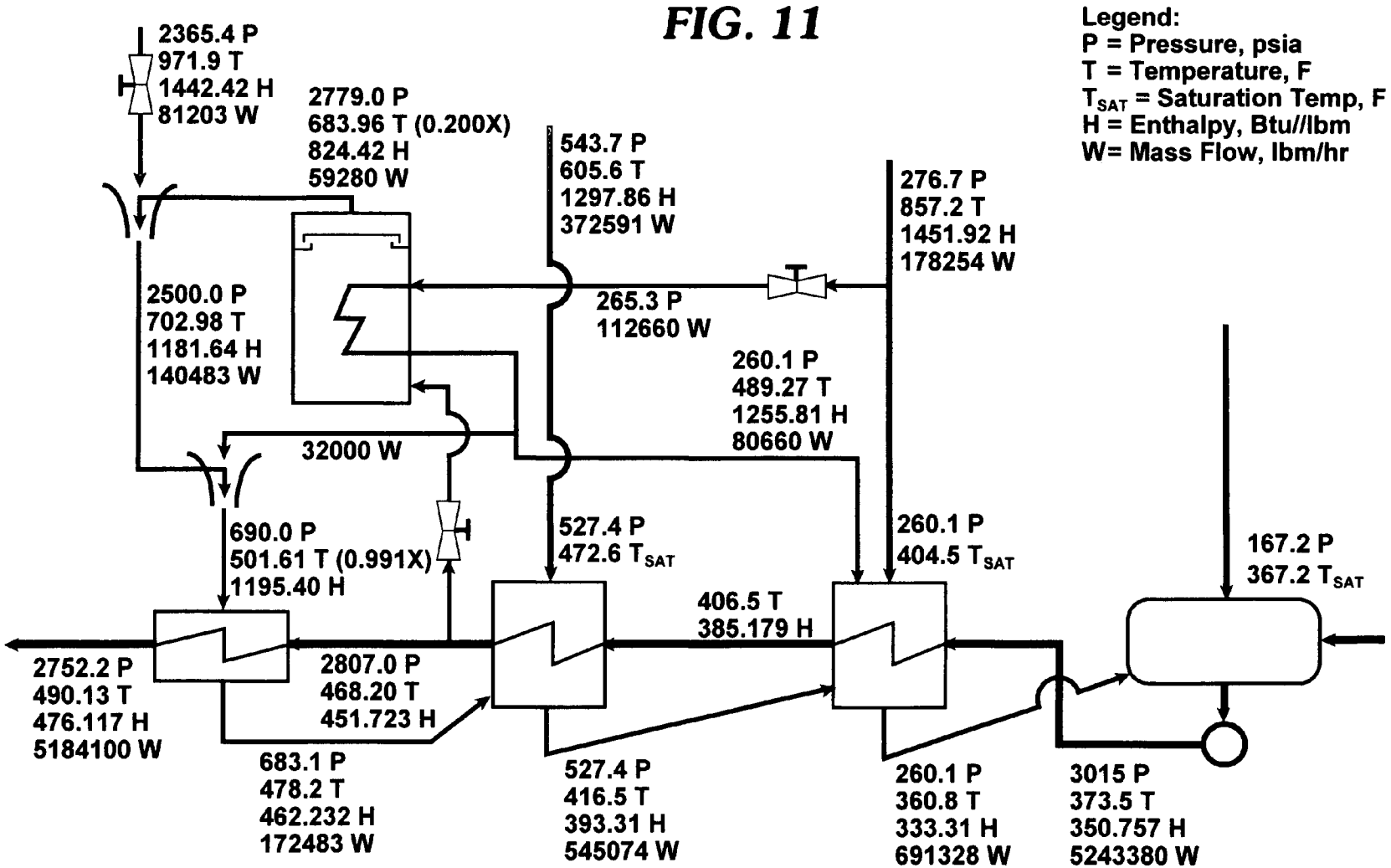
Figure 12:
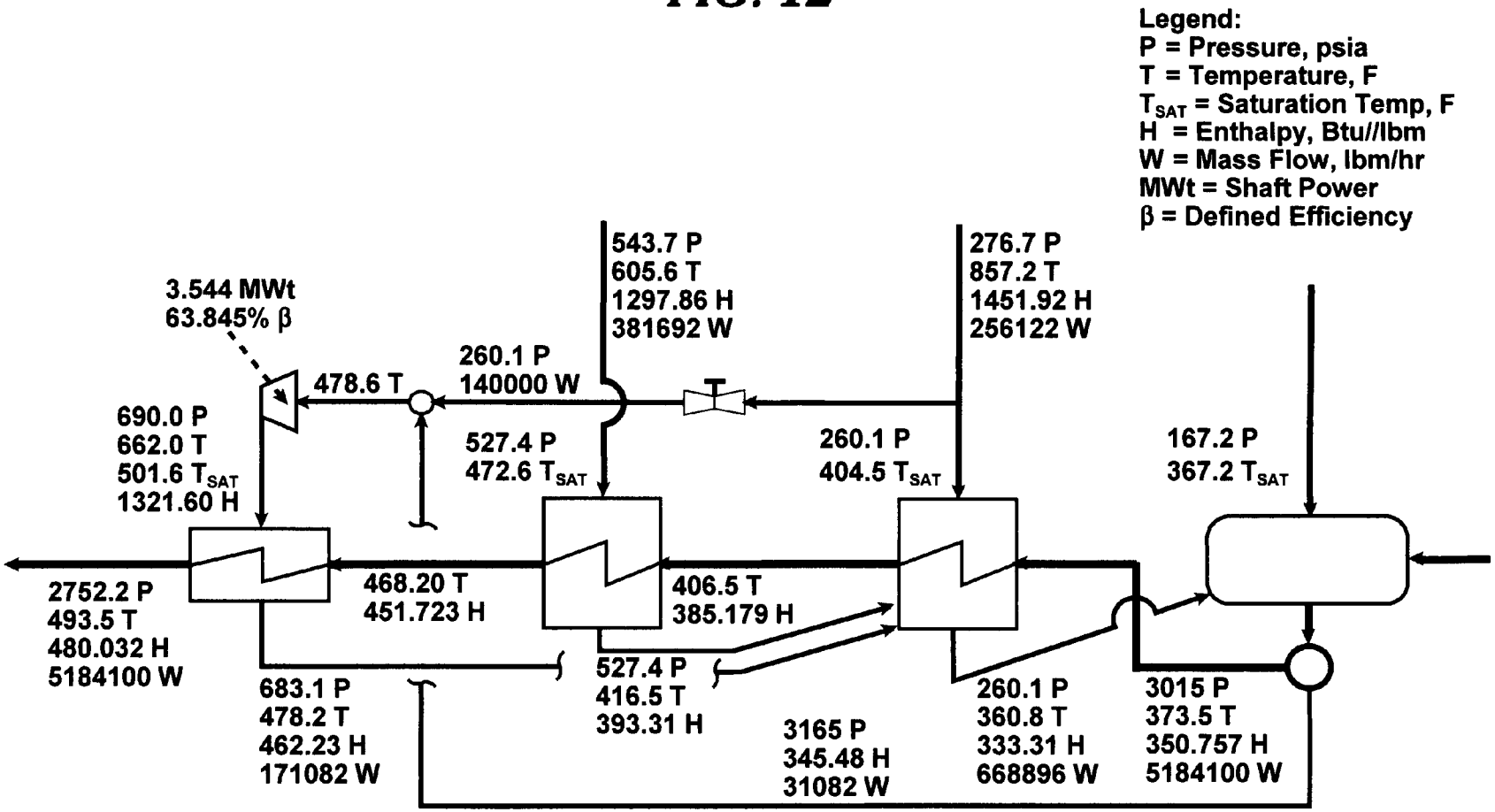
Figure 13:
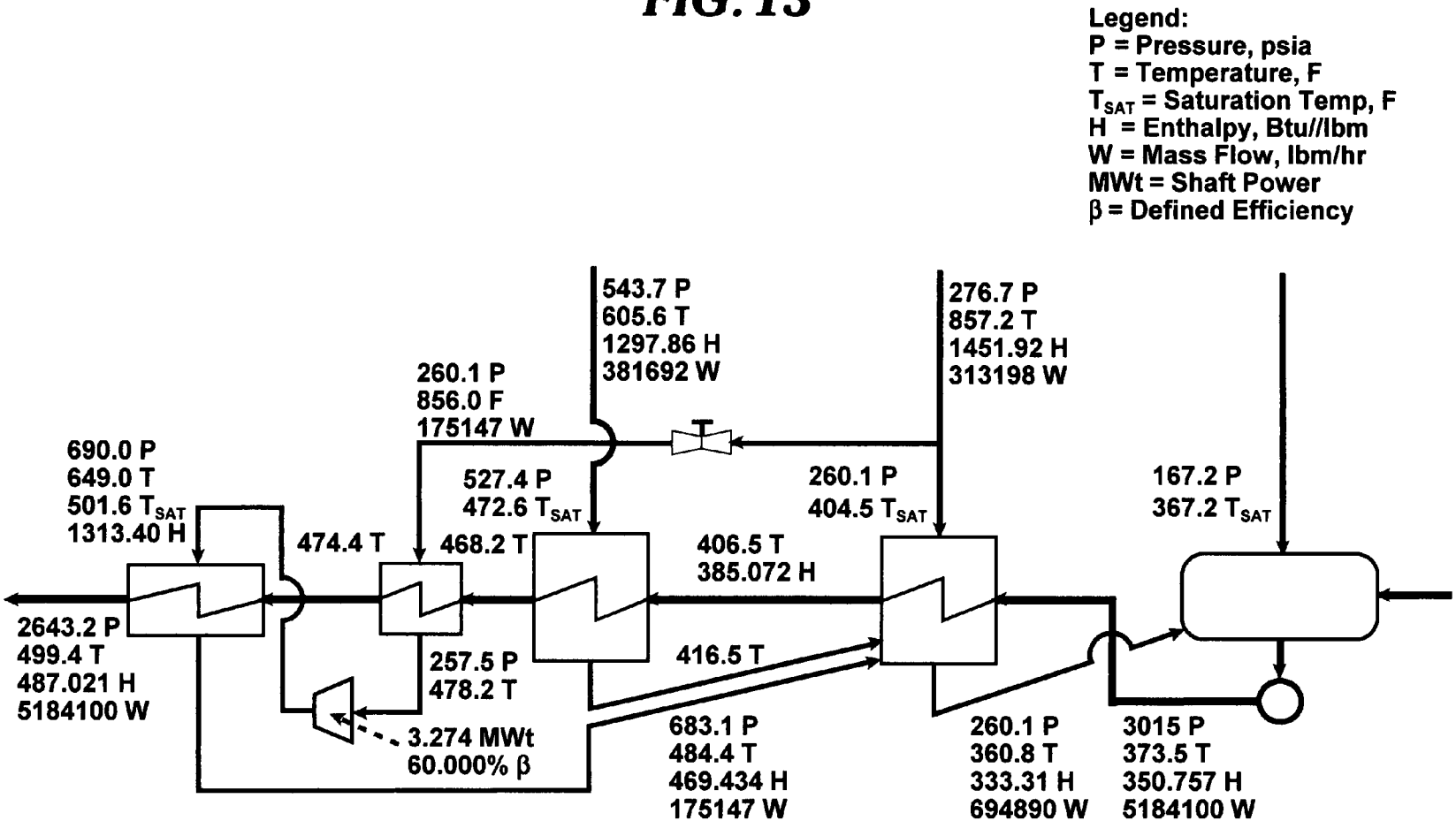
Figure 14:
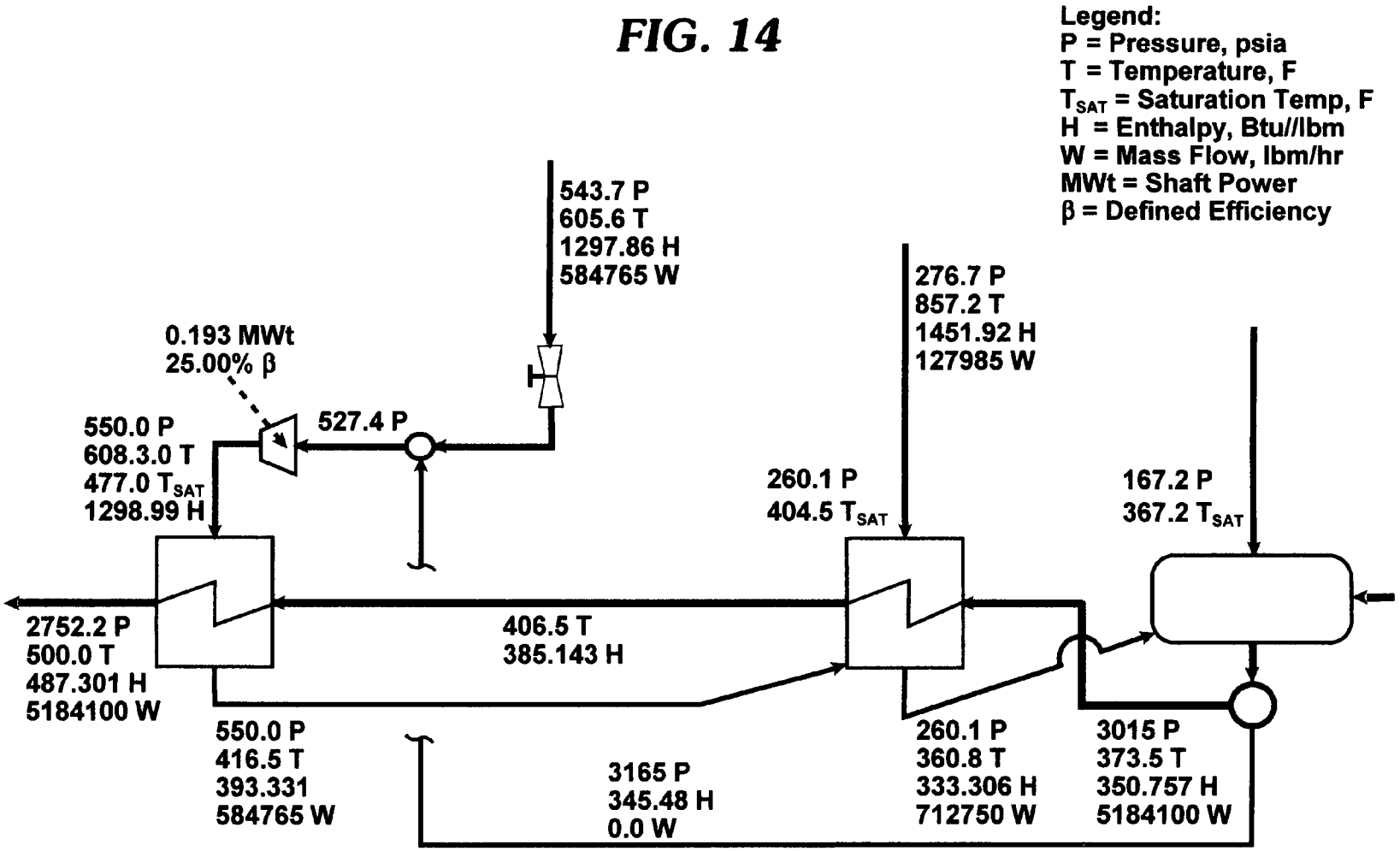

To additionally teach the art, typical mass and energy balances are presented for six embodiments: FIG. 10 teaches the embodiment illustrated in FIG. 5; FIG. 11 teaches the embodiment illustrated in FIG. 6; FIG. 12 teaches the embodiment illustrated in FIG. 7; FIG. 13 teaches the embodiment illustrated in FIG. 8; FIG. 14 teaches the embodiment illustrated in FIG. 4B; and FIG. 15 teaches the embodiment illustrated in FIG. 9. Mass and energy balances involving a thermocompressor are presented in FIG. 10 in which motive steam is obtained from main steam. Note that studies have also been made employing motive steam obtained from the outlet of the Primary Superheater. A mass and energy balance involving the Preferred Embodiment using a reboiler in combination with a thermocompressor is presented in FIG. 11. Mass and energy balances involving a turbo-compressor are presented in FIG. 12, FIG. 13 and FIG. 14. Further still, mass and energy balances associated with FIG. 9 are presented in FIG. 15. It would be obvious to any power plant engineer that numerous variations to these mass and energy balances are to be anticipated: feedwater flows will vary, extraction conditions will vary, final feedwater temperature set-points will vary, etc. Sources of motive steam (if employing a thermocompressor) will vary depending on the acceptability of lost turbine power. Heating feedwater being fed to the reboiler of FIG. 6 may be accomplished using IP turbine extraction steam (as shown). In addition, such reboiler heating may be accomplished using a stream of combustion gas, or the reboiler may be separately fired using a fossil fuel such as natural gas, thus minimizing the use of IP turbine extraction steam.

In one embodiment, an Exergetic Heater System as presented in FIG. 5, as applicable to FIG. 4A, comprises a thermocompressor and an Exergetic Heater. The motive steam driving the thermocompressor is derived from main steam entering the regenerative Rankine cycle. Such motive steam may also be obtained from the outlet header of the Primary Superheater, or from any other source which results in minimizing motive steam flow. The mass and energy balances of FIG. 10, reflecting FIG. 5, are conservative, assuming a 5.00° ΔF (2.78° ΔC) Terminal Temperature Difference (TTD). For the case of FIG. 10, the Drain Cooler Approach Difference (DCA) is 13.60° ΔF (7.6° ΔC). These and other studies of the FIG. 5 embodiment, suggest this embodiment has the advantage of being simple, having no motiving parts, and having highly predictable thermal performance. Although the FIG. 5 embodiment has a decrease of 6.6 ΔMWe in generation, its improved system heat rate may have applicability.

In another embodiment, the Preferred Embodiment, an Exergetic Heater System as presented in FIG. 6 and applicable to the system of FIG. 4A, comprises a reboiler, a thermocompressor and an Exergetic Heater. The reboiler boils sub-cooled water obtained from the feedwater path, heating this water using IP turbine extraction steam. The use of a reboiler, in combination with a thermocompressor, advantages both the high pressure associated with feedwater, although subcooled, but then using the vaporized product from the reboiler to increase the IP turbine extraction pressure by acting as motive steam in a thermocompressor. If the motive steam was not vaporized, it would flash in the throat of the thermocompressor's nozzle, destroying venturi affects. Further, FIG. 11 indicates a further heating of the vaporized product from the reboiler (exiting with a quality of 20%), using a flow of main steam. As indicated in FIG. 11, an attemperator of the direct contact type is employed to mix the vaporized product from the reboiler and the main steam flow. This is arbitrary as it may be the reboiler is separately fired with natural gas, or a higher IP turbine extraction flow is employed, thereby superheating the fluid. If separately fired, the IP turbine extraction steam would be delivered directly as supply steam to the thermocompressor. The Exergetic Heater System presented in FIG. 11 is quite conservative, assuming a 11.48° ΔF (6.38° ΔC) Terminal Temperature Difference (TTD) and 10.00° ΔF (5.56° ΔC) Drain Cooler Approach Difference (DCA) for the condensing Exergetic Heater. For this embodiment the increase in final feedwater temperature is 21.93° ΔF (12.18° ΔC). Note there are no moving parts in this embodiment, thus enhancing reliability. Another advantage of the FIG. 6 embodiment is, if a practical and separate source of fossil fuel is available, apart from the fuel used to fire the steam generator, then using such fuel would have great advantage in achieving both a high pressure and high energy source of motive steam.

Figure 7:
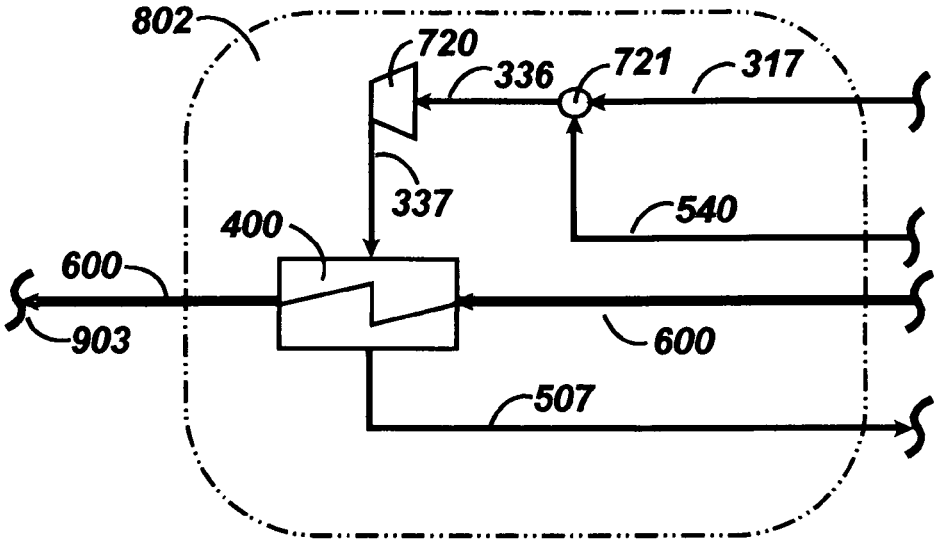

In yet another embodiment, an Exergetic Heater System as presented in FIG. 7 and applicable to the system of FIG. 4A, comprises a turbo-compressor and an Exergetic Heater. The mass and energy balances of FIG. 12, reflecting FIG. 7, are conservative, assuming a 8.10° ΔF (4.50° ΔC) TTD and a 10.0° ΔF (5.56° ΔC) DCA for the condensing Exergetic Heater. The inlet to the turbo-compressor is cooled, using an attemperator, through use of 31,082 lbm/hr (3.916 kg/sec) of boiler feed pump bleed flow to 478.6 F (248.1 C). The turbo-compressor's shaft power of 3.544 MWt is less than the net affects of using thermocompressor without an attemperator, and less than the lost electricity associated with a thermocompressor driven with throttle steam (see FIG. 5). The indicated turbo-compressor performance parameter (β) is a defined term of convenience:

$$\beta=100(h_{Exhaust}-h_{Inlet})/(h_{Isentropic}-h_{Inlet}) \quad (13)$$

Note that the lower the parameter β, the more effective the compressor; that is, the compressor's shaft power decreases when supplying its intended pressure increase. Turbo-compressors are most generally described by their volumetric flow capacity (actual $ft^3$/min) and their developed adiabatic head, $L_{Adb}$. The turbo-compressors demonstrated in various embodiments of this invention are assumed to be aero-derivative machines having adiabatic heads no greater than 35,000 feet/stage (10,668 meter/stage). Most importantly, this embodiment has essentially an infinite operational range, given adjustment of attemperating cooling flow, which is amiable for part-load and variable turbine steam path pressures (the duty on the desuperheater heat exchanger actually increases as load drops).

Figure 8:
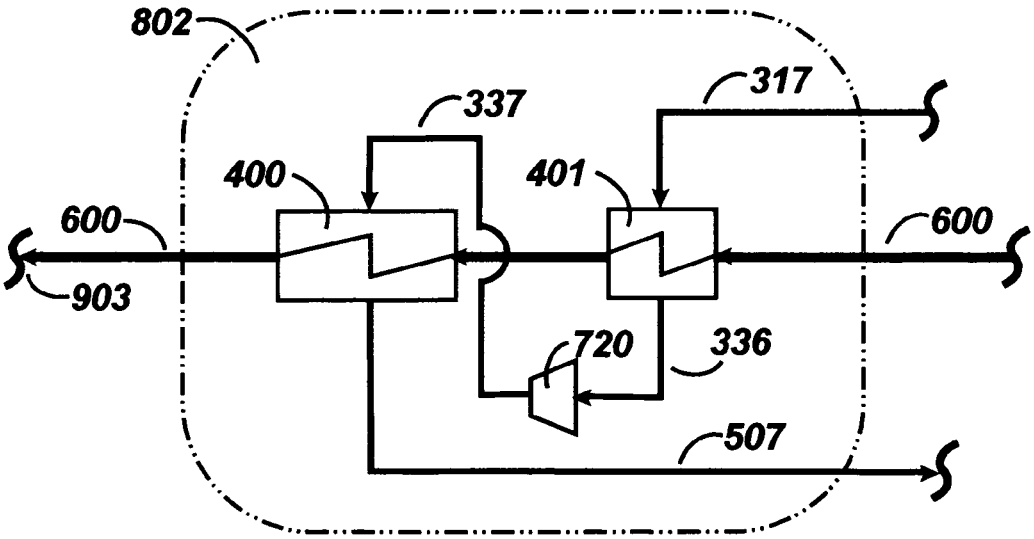

In yet another embodiment, an Exergetic Heater System as presented in FIG. 8 and applicable to the system of FIG. 4A, comprises a desuperheater, a turbo-compressor and an Exergetic Heater. Although similar to the FIG. 7 embodiment, the FIG. 8 embodiment achieves greater flexibility by partially removing the IP turbine extraction's superheat, and thus protecting the turbo-compressor from high temperature. The mass and energy balances of FIG. 13, reflecting FIG. 8, assume a 2.17° ΔF (1.21° ΔC) TTD and 10.00° ΔF (5.56° ΔC) DCA for the condensing Exergetic Heater, while the desuperheater heat exchanger's Final Temperature Difference (FTD) is 3.80° ΔF (2.11° ΔC); the approach of shell outlet and tube inlet temperatures is 10.00° ΔF (5.56° ΔC). The turbo-compressor's shaft power of 3.274 MWt is essentially the same as the turbo-compressor without a tube-in-shell desuperheater (see FIG. 7); it is less than the lost electricity associated with a thermocompressor driven with throttle steam (see FIG. 5). However, when performing similar balances to that of FIG. 13, the power plant engineer will note the high sensitivity associated with the design of the desuperheater heat exchanger. Because the turbo-compressor requires vaporous fluid (high quality or superheated steam), when combined with low IP turbine extraction pressure having high temperature, the possible Δtemperature rise across the desuperheating heat exchange is inherently limiting. In the balance of FIG. 13, the Δtemperature rise is 6.20 F (3.44 C). Condensation can not occur in the desuperheating heat exchanger; and although turbo-compressor is protected from high temperature, the high temperature head is not fully useable. FIG. 13 results demonstrate this situation and are typical. However, the immediate advantage of the FIG. 8 embodiment is that it has a wide operational range which is amiable for part-load and variable turbine steam path pressures (the duty on the desuperheater increases as load drops). Although no spray water is employed inlet to the compressor, it certainly could be considered for additional equipment safety. Although use of a turbo-compressor, being rotating machinery, is not advantageous regards reliability, its high achieved pressure ratio is clearly advantageous in minimizing the use of motive steam and thus minimizing lost of turbine shaft power. In situations where motive steam is to eliminated, the use of turbo-compressors, verus thermocompressors, may be compelling.

Figure 15:
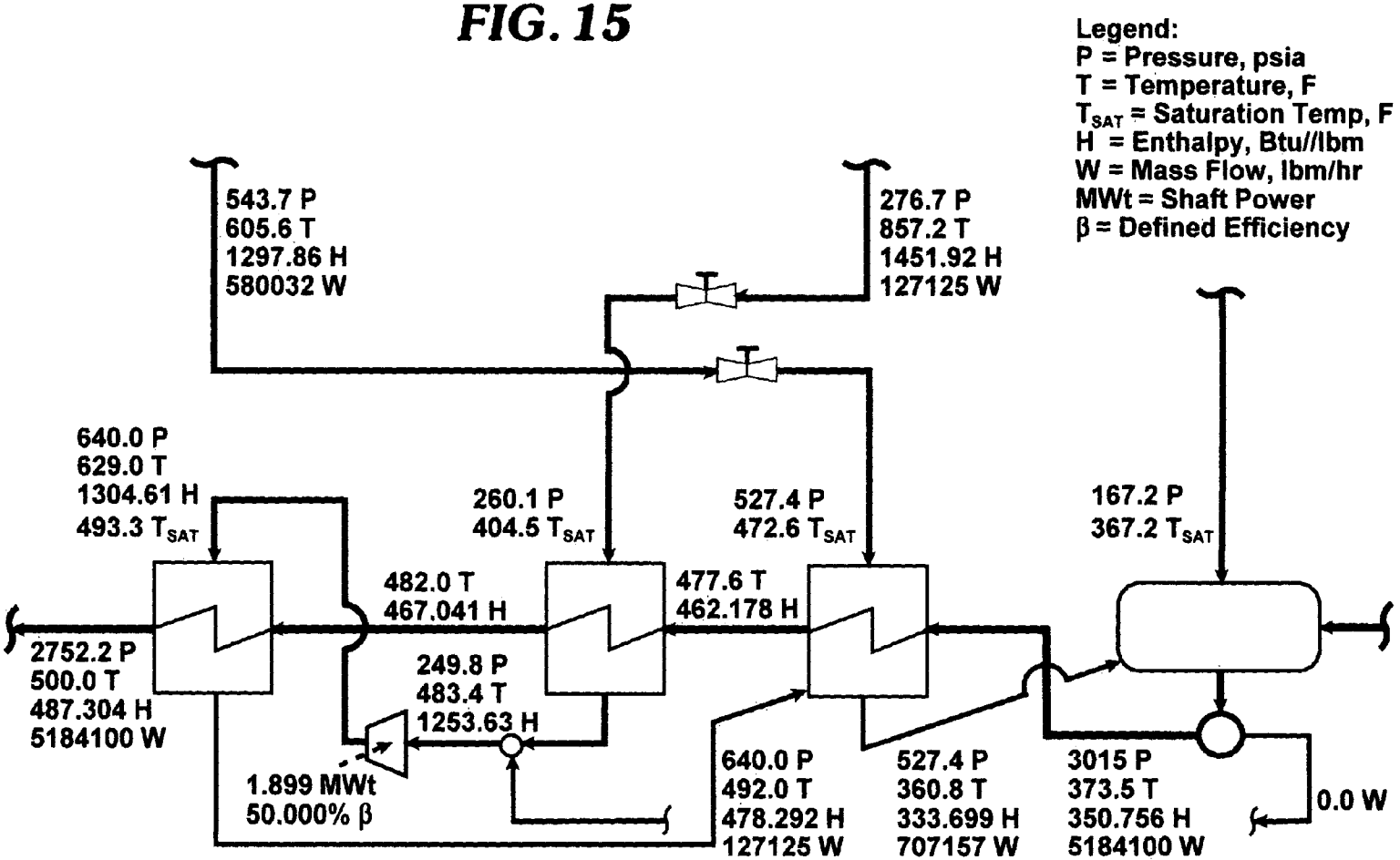

To summarize performances of the embodiments associated with FIG. 5, FIG. 6, and FIG. 7. TABLE A lists differences in extraction steam flows from the HP and IP turbines, compared to as-tested flows. TABLE A's "plant data" comes from an operating power plant whose IP turbine nozzles have eroded, decreasing the final feedwater temperature. This unit's steam generator was designed for over-pressure operation which allows for a higher final feedwater temperature than that associated with nominal throttle pressure operation. If feedwater flow is kept as-tested, per TABLE A, power reductions will result. However, the gain in reduced carbon emissions realized through improved thermal efficiency may represent a substantial financial savings under any of the proposed carbon "cap and trade" systems. This is obviously the situation for the case of the 28.4° ΔF (15.56° ΔC) increase in final feedwater temperature, which represents an increase of 1.82% in unit efficiency, and thus a 1.82% reduction in the plant's carbon foot-print. Also, note that use of a turbo-compressor (last column in TALE A) results in no use of HP turbine steam, but a reduction of 137,376 lbm/hr (62,313 kg/hr) in IP turbine exhaust steam to gain the 1.82% in system efficiency and reduced carbon emissions. These findings are based on a sensitivity of turbine cycle heat rate per final feedwater temperature change of 8.630 ΔBtu/kWh-ΔF (16.389 ΔkJ/kWh-ΔC). TABLE A's indications of the effects on electrical generation are based on differential exergy flow computations (denoted as ΔMWg); assuming a plant gross unit heat rate of 11,700 Btu/kWh (12,344 kJ/kWh) and a boiler efficiency of 87.00%. Taken individually, such exergy computations are conservatively high, but differences between quantities are close approximations to actuals (ΔMWe). The reduction of electrical generation associated with the turbo-compressor (last column) is based on an assumed poor Compressor Performance (thus the relatively low exhaust pressure). FIG. 12 and FIG. 14 employ the basic Exergetic Heater System of FIG. 7 and indicate the affects of a variable Compressor Performance parameter (β) of Eq. (13), and not employing an additional heater. FIG. 13 and FIG. 15 employ the basic Exergetic Heater System of FIG. 8 and indicate the affects of a variable Compressor Performance parameter, and not employing an additional heater.

In yet another embodiment, an Exergetic Heater System as presented in FIG. 4B, comprises a turbo-compressor and an Exergetic Heater which replaces the top heater's extraction system. In this embodiment any degradation caused by the IP turbine's nozzle erosion is immediately corrected by the action of the turbo-compressor. Note that essentially any final feedwater temperature may be achieved by simply increasing the pressure ratio of the turbo-compressor. This embodiment is simple, and if the top in-situ feedwater heater is capable of the intended final feedwater temperature, then it becomes an Exergetic Heater and the only new component needed is a turbo-compressor. The mass and energy balances of FIG. 14, reflecting FIG. 4B, assist in teaching this embodiment.

In yet another embodiment, an Exergetic Heater System as presented in FIG. 9 and applicable to the system of FIG. 4C (and to the system of FIG. 2), comprises an Exergetic Heater, a turbo-compressor and manipulation of extraction line routings. Difficulties described in the proceeding paragraph were resolved through the embodiment of FIG. 9; this, only after hundreds of mass and energy balances, consideration of fundamental cycle thermodynamics and dreams. It occurred, for the North American design (FIG. 3), that if the first two extractions were reversed and an Exergetic Heater System were placed between the first two in-situ feedwater heaters, then the following occurs (see FIG. 9 for feature designations): a separate routing of IP turbine extraction steam is eliminated thus reducing the marked negative impact on turbine shaft power, the IP turbine extraction (329 via 316 to 317) being routed to an Exergetic Heater 400; the high pressure of the HP turbine extraction 319 will, through throttling 333, achieve essentially any TTD desired in a condensing feedwater heater 420 and will govern both the Δtemperature rise across the Exergetic Heater 400 and the inlet temperature to the top heater 410; the top heater's TTD 410 is then governed by the exhaust pressure from the turbo-compressor 720, again offering wide variance; and the turbo-compressor's inlet temperature (via 336) is considerably reduced, although still superheated, given it is controlled by the Exergetic Heater's 400 shell outlet temperature. In FIG. 9, attemperation 721 is shown but is indicated for turbo-compressor equipment safety during upset conditions, and is not required for routine operation. The underlying principles of the FIG. 9 embodiment when applied to the North American design (Exergetic Heater System 804), are identical when applied to the European design (see FIG. 2). Both are brought to the same improved thermal efficiency. In FIG. 2 the Exergetic Heater System 800 is installed between the first two in-situ feedwater heaters. In FIG. 2, the IP turbine extraction 329 is routed to the Exergetic Heater 400 (via throttling valve 316); HP turbine extraction 319 is routed to the second of the in-situ feedwater heaters 412; and the Exergetic Heater System's 800 output 337 is routed to the first of the in-situ feedwater heaters 402. The third of the in-situ feedwater heaters (feature 422 of FIG.

1) is removed. All aforementioned teachings associated with FIG. 9 apply to the Exergetic Heater System 800 of FIG. 2.

The mass and energy balance of FIG. 15, reflecting FIG. 9 in combination with TABLE B, is presented to teach both flexibility and control considerations associated with the Exergetic Heater System presented in FIG. 9. Consideration of FIG. 9 would suggest that the pressure drop of the control valve 333 be minimize provided its feedwater heater 420 is designed for a low TTD (refer to the sensitivity indicated in TABLE B). If however, the heat is designed for a low TTD and the Exergetic Heater System is taken off-line, the turbo-compressor is not performing to design, or its flow 317 is restricted, etc. then throttling 333 will degrade the feedwater heater 420 TTD. Bear in mind that system efficiency is governed by the energy flow to the Reheater (feature 200 in FIG. 3, FIG. 4B and FIG. 4C). If Reheat flow is reduced, given high flow from the HP turbine extraction flowing to Exergetic Heater Systems 800 and 804, then thermal efficiency is improved. Such improvement is in addition to that gained from an increase in final feedwater temperature. If however, extraction flows are to be kept as found in the in-situ system, before application of this invention, then the following expression for extraction flow should be the guide.

$$m_{Ext}=m_{FW}(h_{T\text{-}out}-h_{T\text{-}in})/(h_{S\text{-}in}-h_{D\text{-}out}) \tag{14}$$

where:

$m_{Ext}$=Extraction flow, lbm/hr (kg/sec)

$m_{FW}$=Feedwater flow, lbm/hr (kg/sec)

$h_{T\text{-}out}$=Feedwater heater tube outlet enthalpy, Btu/lbm (kJ/kg)

$h_{T\text{-}in}$ Feedwater heater tube inlet enthalpy, Btu/lbm (kJ/kg)

$h_{S\text{-}in}$ Feedwater heater shell inlet (extraction) enthalpy, Btu/lbm (kJ/kg)

$h_{D\text{-}out}$=Feedwater heater drain outlet enthalpy, Btu/lbm (kJ/kg).

Eq. (14) states that extraction flow may be made the same provided the differences in Δenthalpies remain constant: $(h_{T\text{-}out}-h_{T\text{-}in})\cong(h_{S\text{-}in}-h_{D\text{-}out})$. For example, one may increase $h_{S\text{-}in}$ (given use of an IP turbine extraction) provided $h_{D\text{-}out}$ is also increased, or, rather, $h_{T\text{-}out}$ is increased. Also, an increase in $h_{S\text{-}in}$ may be off-set by a proportional increase in feedwater flow.

TABLE A

Examples of Applying Embodiments of FIG. 5, FIG. 6 and FIG. 7

| Parameter: | Test Data, No Exergetic Heater System | Plant Data, Exergetic Heater System, with Thermo-compressor, FIGS. 5 & 10, low Motive Stm. | Plant Data, Exergetic Heater System with Thermo-compressor, FIG. 5, high Motive Steam. | Plant Data, Exergetic Heater System with Reboiler, Thermocomp., FIGS. 6 & 11 | Plant Data, Exergetic Heater System with Turbo-Compressor, FIGS. 7 & 14 |
|---|---|---|---|---|---|
| Increase Final FW Temp. | 0 ΔF. | 9.80 ΔF. | 28.40 ΔF. | 21.93 ΔF. | 31.8 ΔF. |
| Attainable Final Temp. | 468.2 F. | 478.0 F. | 496.6 F. | 490.1 F. | 500.0 F. |
| Turbine Cycle ΔHeat Rate | 0 ΔBtu/kWh | 85 ΔBtu/kWh | 245 ΔBtu/kWh | 189 ΔBtu/kWh | 247 ΔBtu/kWh |
| Gross Unit Power | 700 MWe | 712 MWe | 712 MWe | 712 MWe | 712 MWe |
| Throttle Press. and Temp. | 2400 psiA and 1000 F. | 2365 psiA and 972 F. | 2365 psiA and 972 F. | 2365 psiA and 972 F. | 2365 psiA and 972 F. |
| Feedwater Flow at BFP | $4.597 \times 10^6$ lb/hr | $5.184 \times 10^6$ lb/hr | $5.184 \times 10^6$ lb/hr | $5.243 \times 10^6$ lb/hr | $5.184 \times 10^6$ lb/hr |
| HP ΔFlow for Motive Steam | 0 Δlb/hr | −39854 Δlb/hr | −140483 Δlb/hr | −81203 Δlb/hr | 0 Δlb/hr |
| Mid-IP Extraction | 158466 lb/hr | 149615 lb/hr | 146729 lb/hr | 178254 lb/hr | 127985 lb/hr |
| IP Turbine Exhaust ΔFlow | 0 Δlb/hr | −31004 Δlb/hr | −128746 Δlb/hr | −135405 Δlb/hr | −172913 Δlb/hr |
| ΔPower with Constant FW | 0 ΔMWg | −6.6 ΔMWg | −26.6 ΔMWg | −18.6 ΔMWg | −34.2 ΔMWg |
| ΔPower with Higher FW | 0 ΔMWg | +8.8 ΔMWg | +25.4 ΔMWg | +19.6 ΔMWg | +24.4 ΔMWg |
| Affect on Net Power | 0 ΔMWe | +2.2 ΔMWe | −1.2 ΔMWe | +1.0 ΔMWe | −9.8 ΔMWe |

TABLE B

Examples of Applying the Embodiment of FIG. 9, Constant FW Flow

| Parameter: | Test Data, No Exergetic Heater System | Decrease Heater #6 TTD | Decrease Heater #6 TTD | Decrease Heater #6 TTD (FIG. 15) | Improve Compressor Performance (β Parameter) |
|---|---|---|---|---|---|
| HP Extraction Pressure Drop | 0.30 ΔP/P | 0.30 ΔP/P | 0.30 ΔP/P | 0.30 ΔP/P | 0.30 ΔP/P |
| Heater #6 TTD | −2.00 ΔF. | +20.00 ΔF. | +5.00 ΔF. | −5.00 ΔF. | −5.00 ΔF. |

TABLE B-continued

Examples of Applying the Embodiment of FIG. 9, Constant FW Flow

| Parameter: | Test Data, No Exergetic Heater System | Decrease Heater #6 TTD | Decrease Heater #6 TTD | Decrease Heater #6 TTD (FIG. 15) | Improve Compressor Performance (β Parameter) |
|---|---|---|---|---|---|
| Exergetic Heater ΔT Rise | — | 9.74 ΔF. | 6.49 ΔF. | 4.39 ΔF. | 3.45 ΔF. |
| Compressor Flow | — | 261734 Δlb/hr | 182235 Δlb/hr | 127125 Δlb/hr | 101700 Δlb/hr |
| Compressor Exhaust Press. | — | 600 psiA | 600 psiA | 640 psiA | 680 psiA |
| Compressor Performance, β | — | 50.00% | 50.00% | 50.00% | 25.00% |
| Compressor Power | — | 3.51 MWt | 2.49 MWt | 1.90 MWt | 0.97 MWt |
| Heater #7 TTD | +4.43 ΔF. | −13.70 ΔF. | −13.70 ΔF. | −6.70 ΔF. | −6.70 ΔF. |
| Difference in HP Extraction | 0 Δlb/hr | 46397 Δlb/hr | 142219 Δlb/hr | 208233 Δlb/hr | 241485 Δlb/hr |
| Difference in Mid-IP Extrac. | 0 Δlb/hr | 102132 Δlb/hr | 22642 Δlb/hr | −32474 Δlb/hr | −57899 Δlb/hr |
| ΔPower with Constant FW | 0 ΔMWe | −18.14 ΔMWe | −17.88 ΔMWe | −17.77 ΔMWe | −17.18 ΔMWe |
| Increase Final FW Temp. | 31.81 ΔF. | 31.81 ΔF. | 31.81 ΔF. | 31.81 ΔF. | 31.81 ΔF. |
| Increase Thermal Eff. | 0.00 % | 0.71% | 1.15% | 1.44% | 1.67 % |

An objective of the present invention is controlling the final feedwater temperature associated with a regenerative Rankine cycle. This is accomplished by manual adjustment of a control valves (e.g., manual operation of control valves 316 and/or 333 in FIG. 2, FIG. 4A, FIG. 4B or FIG. 4C), and/or adjustment being made to the compressor device. If an automated controller is used it would receive, at a minimum, a signal of the actual final feedwater temperature to actuate the control valve such that the actual final feedwater temperature agrees with a determined final feedwater temperature set-point within a defined tolerance. Such defined tolerance may be taken as 1.8° ΔF (1° ΔC), or that which may be accomplished using common industrial art which is the preferred embodiment. The final feedwater temperature set-point may be a constant value; or the final feedwater temperature set-point may vary as a function of power output thus accounting for variations in turbine cycle extraction conditions as load is reduced.

Further, determination of the final feedwater temperature set-point, at a given power output, may be determined in an iterative manner such that system thermal efficiency is maximized. As taught in the sections above, turbine cycle efficiency is linear with Useful Energy Flow Supplied (ΣmΔh) given constant power, thus the controller would be expected to response in a linear manner to any degradation in the final feedwater temperature. Indeed, the computation of turbine cycle efficiency in real-time is considered common art, see Eqs. (5) and (2). However, as taught above, affects of final feedwater temperature on boiler efficiency are non-linear, see Eq. (8) and associated discussions, and may oppose turbine cycle efficiency. Therefore it becomes necessary to compute boiler efficiency in real-time. Thus the resultant system thermal efficiency may be computationally optimized by simply varying the final feedwater temperature set-point until system thermal efficiency is maximized, determined by computing both turbine cycle and boiler efficiencies, limited by an upper practical limit on final feedwater temperature. Such efficiency computations may occur within the controller (e.g., 417 in FIG. 2, FIG. 4A and FIG. 4C), or may occur in a personal computer whose output signal is the optimized final feedwater temperature set-point. The optimized final feedwater temperature set-point then becomes an input signal to the controller such that it actuates the control valves (e.g., 316 and 333 in FIG. 2 or FIG. 4C, or 316 in FIG. 4A) until the final feedwater temperature agrees with the final feedwater temperature set-point.

Further still, knowledge of degradation in the IP turbine inlet nozzle may add important information for refining the control of the final feedwater temperature. If the Flow Passing Ability of the IP turbine is evaluated in real-time, then an off-setting action may ensue within the controller. Such off-setting action is based on the design IP turbine inlet pressure to be expected if no nozzle degradation was present. This pressure, $P_{B\text{-}Design}$, is then translated to a positive change in final feedwater temperature based on Δsaturated temperatures. Eqs. (15) and (16) terms are defined as follows: $\Delta P/P_{Ext}$ is the relative pressure change from the IP turbine inlet minus the shell-side of the final Exergetic Heater divided by the IP turbine inlet; $T_{Act\text{-}FW}$ is the actual final feedwater temperature; and $T_{sat/Act}$ is the actual shell-side saturation temperature associated with the top feedwater heater:

$$T_{sat/Design}=f[P_{B\text{-}Design}(1.0-\Delta P/P_{Ext})] \quad (15)$$

$$T_{Final\text{-}FW}=T_{Act\text{-}FW}+(T_{sat/Design}-T_{sat/Act}) \quad (16)$$

It is to be noted that computing the Flow Passing Ability of the IP turbine in real-time may have importance since it is not uncommon to fine Hot Reheat temperature off-design, which directly impacts a computed Flow Passing Ability, aside of nozzle erosion. This suggests that for some situations, a superficial evaluation of IP turbine performance by only monitoring extraction pressure (thus saturation temperature) may not be acceptable.

Although the present invention has been described in considerable detail with regard to several embodiments, other embodiments within the scope of the present invention are possible without departing from the spirit and general industrial applicability of the invention. Accordingly, the general theme and scope of the appended claims should not be limited to the descriptions of the preferred embodiment disclosed herein. For example, the working fluid discussed in the specification herein has been water. The invention may apply to any fluid, as long as it is a working fluid to a regenerative Rankine cycle. Further, although the source of working fluid used to heat feedwater within an Exergetic Heater System is obtained from the IP turbine (given its high temperature after Reheat), it may be taken from an alternative source, if available. For some unique power plant designs such an alternative source of high temperature steam may be associated with a double Reheat design consisting of a Very High Pressure turbine, $1^{st}$ Reheat, High Pressure turbine, $1^{st}$ Reheat, IP turbine and LP turbine; thus the alternative source may be obtained following the $1^{st}$ Reheat (the High Pressure turbine), or following the $2^{nd}$ Reheat (the IP turbine). In general, this invention is especially applicable to power plants fueled by fossil fuel employing at least one Reheater in its steam generator, the reheated steam being typically delivered to an Intermediate Pressure (IP) turbine.

THE DRAWINGS

FIG. 1 and FIG. 3 represent the high pressure (HP) portion of typical regenerative Rankine cycles employing a reheating 200 of the working fluid, but illustrating different feedwater heater configurations. FIG. 1 illustrates a design principally used in Europe. FIG. 3 illustrates a design principally found in North America. FIG. 1 and FIG. 3 are prior art. Since the regenerative Rankine cycle has been in use for over a hundred years, numerous variations have evolved. Variations to the turbine configurations of these cycles, versus that assumed in FIG. 1 and FIG. 3, which does not impact the spirit and general industrial applicability of the present invention include, for example: turbine shaft leakage locations and routings; location and/or use of Reheater attemperation (i.e., the control of Reheater outlet temperature); the HP turbine could be replaced with a Very High Pressure (VHP) turbine followed by a First Reheater, followed by an HP turbine followed by Second Reheater (replacing 110, 120 and 200); valve leakages and turbine seal flows may take numerous configurations (i.e., variations to those illustrated by features 101, 103, 105 and 107); etc. The numerous variations to feedwater heater configurations of these cycles, versus that assumed in FIG. 1 and FIG. 3, does not impact the spirit and general industrial applicability of the present invention. Variations to feedwater heater configurations will not affect the scope of the present invention if they do not concern themselves with: the placement of an Exergetic Heater System in the feedwater path of a regenerative Rankine cycle; an Exergetic Heater System whose driving steam is derived from within the system (typically from an IP turbine extraction); and/or the feedwater heating conducted by an Exergetic Heater System whose heating is being controlled by certain thermal performance parameters as described herein.

FIG. 1 through FIG. 9 employ some of the same designation numbers for the same features. These same features are listed in this paragraph and in the following paragraph. Item 100 defines the turbine steam path, that is the flow path through the HP turbines 110 & 120, the Reheater 200, the Intercept Valve 109, and the IP turbines 130 and 140. Item 110 is the Governing Stage of the HP turbine (or could represent a constant nozzle area turbine). Item 120 is the Second Stage Group of the HP turbine. Item 130 is the First Stage Group of the IP turbine. Item 140 is the Second Stage Group of the IP turbine. Each stage group typically contains one or more individual stages; each stage consisting of a fixed ring of nozzles followed by rotating turbine blades attached to the turbine's shaft. Features 101, 103 and 107 represents typical turbine seal flows and valve stem leakages. Feature 105 represents Reheat attemperation spray flow. Item 109 is the Intercept Valve. Item 600 defines the feedwater path, that is the feedwater initiating from the Deaerator (in Europe termed the Feedwater Tank) 430, through the boiler feedwater pump 711, and through the tube-side of closed feedwater heaters, said heaters being further described below.

In FIG. 1, FIG. 2, FIG. 3, FIG. 4A, FIG. 4B, FIG. 4C and elsewhere herein, item 901 represents the boundary between the regenerative Rankine cycle and the steam generator indicating steam being delivered from the steam generator. The enthalpy associated with 901 is described by $h_{Throttle}$ of Eq. (5). Item 903 represents the boundary between the regenerative Rankine cycle and the steam generator indicating feedwater being delivered to the steam generator. The temperature and enthalpy associated with the boundary 903 are described by $T_{Final\text{-}FW}$ and $h_{Final\text{-}FW}$. $h_{Final\text{-}FW}$ is a parameter used in Eq. (5). $T_{Final\text{-}FW}$ is the final feedwater temperature. Item 921 represents the boundary between the regenerative Rankine cycle and the steam generator indicating HP turbine exhaust steam being delivered to the Reheater 200, an integral steam generator heat exchanger. The enthalpy associated with 921 is described by $h_{CRH}$ of Eq. (5), termed Cold Reheat (CRH). Item 922 represents the boundary between the regenerative Rankine cycle and the steam generator indicating re-heated steam being delivered from steam generator's Reheater 200. The enthalpy associated with 922 is described by $h_{HRH}$ of Eq. (5), termed Hot Reheat (HRH). Item 905 represents a continuation of the regenerative Rankine cycle, those turbine steam path 100 typically would flow to the cycle's LP turbine. Item 907 represents a continuation of the regenerative Rankine cycle, those condensate 610 typically would flow from the cycle's low pressure feedwater heaters to the Deaerator 430.

In FIG. 1 feedwater heaters are designated as the top (i.e., the last heater in the feedwater path) of the in-situ feedwater heaters 402, the second heater 412, the third heater 422, and the fourth heater 430 (the Deaerator, DA, or Feed Tank). These three heaters are original, defined herein as "in-situ feedwater heaters", that is before the application of the present invention (as depicted in FIG. 1). Heater 402 receives extraction steam 322 from IP turbine 130. Heater 402 delivers steam in a superheated state 505 to the shell-side of heater 422. Note that 505 carries superheated steam given the pressure of 402 is less than that associated with 412, thus the saturation temperature of 402 may not allow the removal of latent heat associated with its extraction steam 322. Heater 412 receives extraction steam 312 from HP turbine 120. Heater 412 drains 511 to heater 422. Heater 422 receives is shell-side steam 505 from the top heater 402. Heater 422 drains 521 to heater 430. Heater 430 receives extraction steam 330 from IP turbine 140. The drains from heater 430, collecting both 330 and 520 flows, forms the feedwater flow 600. Item 711 is a boiler feedwater pump used to increase system pressure.

For FIG. 1 and elsewhere herein, including CLAIMS, the words "Exergetic Heater System" is a term herein defined as comprising a heater exchanger, termed an "Exergetic Heater", and a compressor device for increasing the pressure of steam. An Exergetic Heater System when placed in the feedwater path of a regenerative Rankine cycle heats the feedwater causing the final feedwater temperature to increase to a desired value. In the Preferred Embodiment said appropriate energy flow for feedwater heating is derived from an Intermediate Pressure (IP) turbine extraction. In the Preferred Embodiment, the Exergetic Heater has a shell-side and tube-side configuration as depicted as feature 400 in FIG. 2, FIG.

4A, FIG. 4B, FIG. 4C and FIG. 5 through FIG. 9. One embodiment of the Exergetic Heater System is depicted as 800 in FIG. 2. Another embodiment of the Exergetic Heater System is depicted as 802 in FIG. 4A with details taught in FIG. 5 through FIG. 8. Yet another embodiment of the Exergetic Heater System is depicted as 803 in FIG. 4B. Yet another embodiment of the Exergetic Heater System is depicted as 804 in FIG. 4C with details taught in FIG. 9. Instrumentation and the controller needed to control the Exergetic Heater System (in FIG. 2, FIG. 4A, FIG. 4B and FIG. 4C features 417, 430, etc. are described below).

In FIG. 2 the Exergetic Heater System 800 receives IP turbine extraction system via 329, flowing through control valve 316, and delivered via 317 to Exergetic Heater 400. HP turbine extraction 319, is routed through a control valve 333 and pipe 334 before being delivered to heater 412. The shell outlet flow 335 from Exergetic Heater 400 flows to the supply side of attemperator 721. The cooling fluid 540 to attemperator 721 is derived from a suitable location within the cycle, typically 540 is obtained directly from the boiler feedwater pump. The mixed fluid 336 is routed to a turbo-compressor 720 and then via 337 to the top feedwater heater 402. The Exergetic Heater System 800 produces high pressure steam which is suitable for heating feedwater, via sensible cooling and liberating its latent heat, in the top feedwater heater 402, said high pressure steam delivered via 337 to heater 402. The top heater 402 produces condensed (sub-cooled) fluid 506, which flows to a lower pressure in-situ feedwater heater (typically 412). The sub-cooled drains 509 from feedwater heater 412 flow to the DA 430. It should be noted that heater 422 of FIG. 1, is eliminated after application of Exergetic Heater System 800.

In FIG. 3 feedwater heaters are designated as the top (i.e., the highest pressure heater in North American designs, and last heater in the feedwater path) of the in-situ feedwater heaters 410, the second highest pressure heater 420, and the third highest pressure heater 430 (the DA). These three heaters are original, defined herein as in-situ feedwater heaters, that is before the application of the present invention (as depicted in FIG. 3). Heater 410 receives extraction steam 310 from HP turbine 120. Heater 420 receives extraction steam 320 from IP turbine 130. Heater 430 receives extraction steam 330 from IP turbine 140. Heater 410 drains 510 to heater 420. Heater 420 drains 520 to heater 430. The drains from heater 430 (the DA) collecting both 330 and 520 flows, forms the feedwater flow 600. Item 711 is a boiler feedwater pump used to increase system pressure.

In FIG. 4A, Exergetic Heater System 802 receives IP turbine extraction steam via 315, controlled by control valve 316, delivered via 317. Feature 802 is representative of four embodiments of the Exergetic Heater System, detailed in FIG. 5, FIG. 6, FIG. 7 and FIG. 8. The Exergetic Heater System produces condensed fluid 507, which flows to a lower pressure in-situ feedwater heater.

In FIG. 4B, Exergetic Heater System 803 receives HP turbine extraction steam via 334, controlled by control valve 332, delivered via 310. The System compresses extraction steam via a compressor device 720, delivering the compressed steam via 337 to an Exergetic Heater acting as the top feedwater heater 400. The Exergetic Heater 400 produces condensed (sub-cooled) fluid 510, which flows to a lower pressure in-situ feedwater heater (typically 420 of FIG. 3).

In FIG. 4C, Exergetic Heater System 804 receives IP turbine extraction steam 329, through controlled by control valve 316, flowing via 317. Feature 804 is representative of the embodiment detailed in FIG. 9. The Exergetic Heater System 804 produces high pressure steam which is suitable for heating feedwater, via sensible cooling and liberating its latent heat, in the top feedwater heater 410 of FIG. 3 said high pressure steam delivered via 337 to heater 410. The top heater 410 produces condensed (sub-cooled) fluid 506, which flows to a lower pressure in-situ feedwater heater (typically 420 of FIG. 3). The sub-cooled drains 509 from feedwater heater 420 flow to the DA 430 as seen in FIG. 3.

In FIG. 2, FIG. 4A, FIG. 4B and FIG. 4C, signals from instrumentation used to control the Exergetic Heater System are represented by feature 430, said signals connected to controller 417. Instrumentation comprises: an instrument 412 measuring the inlet pressure of the IP turbine 130; an instrument 411 measuring the inlet temperature of the IP turbine 130; an instrument 416 measuring the feedwater temperature inlet to the Exergetic Heater System; an instrument 413 measuring the final feedwater temperature, $T_{Final\text{-}FW}$, before said feedwater enters the steam generator 903; an instrument 420 measuring the extraction pressure of IP turbine 130; and an instrument 421 measuring the extraction temperature of IP turbine 130. In addition, for FIG. 2 and FIG. 4C instrumentation also comprises: an instrument 426 measuring the outlet temperature of the Exergetic Heater System before feedwater enters the top feedwater heater; and an instrument 427 measuring the drain outlet temperature of the top feedwater heater. In addition, for FIG. 4A instrumentation also comprises an instrument 437 measuring the drain outlet temperature on pipe 507 from the Exergetic Heater associated with Exergetic Heater System 802. To assure that the outlet drains form the top feedwater heater are subcooled, and thus assuring that latent heat has been removed from extraction steam 317, the controller 417 may consider any portion or all of the available instrumentation signals 430. In addition, for the embodiments of FIG. 2 and FIG. 9 control of the turbo-compressor 720 may be required to assist in achieving a minimum of extraction flow when operating an Exergetic Heater System.

FIG. 5 describes an embodiment of an Exergetic Heater System 802. In FIG. 5, IP turbine extraction steam is delivered 317 as supply steam to a thermocompressor 823. Motive steam to 823 is obtained from a high pressure source of steam within the regenerative Rankine cycle 813, controlled via a control valve 815 and delivered via 817 to the thermocompressor 823. Outlet flow 825 from the thermocompressor 823, now at a pressure higher than IP turbine extraction pressure 317, is delivered to the shell-side of Exergetic Heater 400, thereby heating feedwater 600. The Exergetic Heater 400 condenses the steam 825 entering its shell, its condensed drains flowing 507 to a lower pressure in-situ feedwater heater.

FIG. 6 describes another embodiment of an Exergetic Heater System 802. In FIG. 6, high pressure subcooled feedwater is routed 826, through control valve 827, via 809 to a reboiler 807. This fluid is boiled at high pressure in reboiler 807, using as a heating medium IP turbine extraction steam 317 routed through the tube-side of reboiler 807. The tube-side outlet 1802 is routed in-part via 805 to the supply side of a thermocompressor 823, and via 1803 to the shell-side of a lower pressure in-situ feedwater heater (for example, 430 shown in FIG. 4A). The shell outlet flow 808 of the reboiler 807 is used as motive steam to a thermocompressor 819, whose supply steam is also high pressure steam delivered 813, through control valve 815 and pipe 817. Thermocompressor 819 may be replaced with a simple attemperation device suitable for mixing high temperature steam flows having similar pressures. The outlet of the resultant mixed steam 821 is used as motive steam to thermocompressor 823, thereby increasing pressure of the extraction steam 805. The resultant output from thermocompressor 823, via 825, heats feedwater in an Exergetic Heater 400. The Exergetic Heater 400 condenses the steam entering its shell, its condensed drains flowing 507 to a lower pressure in-situ feedwater heater.

In FIG. 7, FIG. 8 and FIG. 9 feature 336 is the inlet flow to a turbo-compressor 720, the turbo-compressor's exhaust flow is feature 337. The inlet flow to the turbo-compressor 720 may be attemperated 721 to a lower temperature (resulting in a mixed flow 336 amenable for turbo-compressor operations). Such attemperating fluid may be delivered 540 from a bleed take-off obtained from the boiler feedwater pump 711.

FIG. 7 describes yet another embodiment of an Exergetic Heater System 802. In this embodiment, the turbo-compressor is supplied extraction steam 317 by way of an IP turbine extraction. The extraction steam 317 may be attemperated 721. The turbo-compressor's exhaust flow 337 is delivered to the Exergetic Heater 400. The Exergetic Heater 400 condenses the steam entering its shell, its condensed drains flowing 507 to a lower pressure in-situ feedwater heater.

FIG. 8 describes yet another embodiment of an Exergetic Heater System 802. In this embodiment, two heat exchangers and a turbo-compressor are employed. IP turbine extraction steam 317 is first delivered to a desuperheating heat exchanger 401. Outlet steam 336 from 401, still superheated but at a temperature amenable for turbo-compressor operation, is then delivered to the turbo-compressor 720. The steam is compressed and delivered 337 to the shell-side of the Exergetic Heater 400. The Exergetic Heater 400 condenses the steam entering its shell, its condensed drains flowing 507 to a lower pressure in-situ feedwater heater.

FIG. 9 describes yet another embodiment of an Exergetic Heater System 804. This embodiment employs an Exergetic Heater, a turbo-compressor and manipulation of extraction line routings. Exergetic Heater System 804 receives IP turbine extraction steam 329, via control valve 316, and delivered 317 to an Exergetic Heater 400. Without Exergetic Heater System 804, turbine extraction 329 would be routed to feedwater heater 420 (said feature 320 in FIG. 3). The Exergetic Heater 400 is designed to desuperheat 317, but not condensing. Outlet steam 335 from 400, still superheated but at a temperature amenable for turbo-compressor operation, is then delivered to the turbo-compressor 720. The inlet flow to the turbo-compressor 720 may be attemperated 721 to a lower temperature (resulting in a mixed flow 336 amenable for turbo-compressor inlet conditions). Such attemperating fluid may be delivered 540 from a bleed take-off obtained from the boiler feedwater pump 711. However, it is unlikely that attemperation would be required if the Exergetic Heater System 804 is properly operated. Proper operation implies control of the pressure drop, via control valve 333, such that the Terminal Temperature Difference of heater 420 is adjusted to allow the correct Δtemperature rise across the Exergetic Heater 400, this anticipating the Δtemperature rise across the top feedwater heater 410. The compressed steam is delivered 337 to the shell-side of the top in-situ feedwater heater 410. Note that the pressure ratio achieved by the turbo-compressor will govern, through its resultant saturation temperature, and with heating accomplished in the Exergetic Heater 400, the Δtemperature rise across the top heater 410. The feedwater heater 410 condenses the steam entering its shell, its condensed drains flowing 506 to a lower pressure in-situ feedwater heater 420, as in the un-modified system of FIG. 3. Drains from 420 are routed to the DA 430 via 509.

FIG. 10 present industrially applicable mass and energy balances which further teach the embodiment associated with FIG. 5 those thermocompressor employs either main steam (shown in FIG. 10), or steam from the outlet of the Primary Superheater, or another suitable source.

FIG. 11 presents an industrially applicable mass and energy balance which further teaches the embodiment associated with FIG. 6 using a reboiler, a thermocompressor with motive steam from main steam, and an Exergetic Heater.

FIG. 12 presents an industrially applicable mass and energy balance which further teaches the embodiment associated with FIG. 7 using a turbo-compressor and an Exergetic Heater.

FIG. 13 presents an industrially applicable mass and energy balance which further teaches the embodiment associated with FIG. 8 using a desuperheating heat exchanger, a turbo-compressor and an Exergetic Heater.

FIG. 14 presents an industrially applicable mass and energy balance which further teaches the embodiment associated with FIG. 4B using either a turbo-compressor or blower and an Exergetic Heater.

FIG. 15 presents industrially applicable mass and energy balances which further teach the embodiment associated with FIG. 9 using a turbo-compressor, an Exergetic Heater, and manipulation of the routing of turbine extraction steam.

For FIG. 1 and elsewhere herein, including CLAIMS, if used, the words "obtain", "obtained", "obtaining", "determine", "determined", "determining" or "determination" are defined as measuring, calculating, computing by computer, assuming, estimating or gathering from a database. The words "establish", "established" or "establishing" are defined as measuring, calculating, computing by computer, assuming, estimating or gathering from a database.

For FIG. 1 and elsewhere, including CLAIMS, the words "in-situ feedwater heater" is a term defined herein as a heat exchanger found in the original regenerative Rankine cycle in which the feedwater is heated by condensing turbine extraction steam within the feedwater heater path. Typically the shell-side of such an in-situ feedwater heater receives the extraction steam, the tube-side bears feedwater which is being heated.

For FIG. 1 and elsewhere, including CLAIMS, the words "steam generator" is a term defined herein as meaning any device or method which adds energy to a working fluid. In conventional usage, a steam generator burns a fossil fuel, the working fluid being water, energy from that combustion is taken up by water to the point that a superheated state is reached, i.e., steam is produced. Although "steam generator" invokes a heating of water (i.e., steam), its definition, as defined herein, is taken for readability. This invention applies to any working fluid: water, hydrocarbon fluid, liquid metal, etc.

For FIG. 1 and elsewhere, including CLAIMS, the words "final feedwater temperature" is a term defined herein as meaning the temperature of the subcooled working fluid taken along the feedwater path at a location between the regenerative Rankine cycle and the steam generator. For example, the final feedwater temperature associated with FIG. 1 through FIG. 9 is described by feature 903. The final feedwater temperature is measured in FIG. 2, FIG. 4A, FIG. 4B, and FIG. 4C by feature 413.

What is claimed is:

1. A method for quantifying the operation of a thermal system in which its thermal efficiency is to be improved, the thermal system consisting of a steam generator and a regenerative Rankine cycle, the regenerative Rankine cycle having a feedwater path carrying a high pressure feedwater flow, and a turbine supplying an extraction steam flow, the method comprising the steps of:

using a reboiler to vaporize a portion of the high pressure feedwater flow resulting in a reboiler outlet flow;

using a thermocompressor to increase the pressure of the extraction steam flow wherein its motive flow employs the reboiler output flow, and its supply flow employs the extraction steam flow, resulting in a higher pressure extraction steam flow; and using the higher pressure extraction steam flow in a condensing feedwater heater, which causes an increase in final feedwater temperature thereby improving the system's thermal efficiency.

2. A method for quantifying the operation of a thermal system in which its thermal efficiency is to be improved, the thermal system consisting of a steam generator and a regenerative Rankine cycle, the regenerative Rankine cycle having a feedwater path carrying a high pressure feedwater flow, and a turbine supplying a high temperature extraction steam flow, the method comprising the steps of:

installing a reboiler in the thermal system which, by using the high temperature extraction steam flow, causes a portion of the high pressure feedwater flow to vaporize resulting in a reboiler outlet flow;

installing a thermocompressor in the thermal system wherein its motive flow employs the reboiler output flow, and wherein its supply flow employs the high temperature extraction steam flow resulting in a higher pressure extraction steam flow; and using the higher pressure extraction steam flow in a condensing feedwater heater thereby increasing the thermal system's final feedwater temperature entering the steam generator and thereby improving the system's thermal efficiency.

3. The method of claim 2 wherein using the higher pressure extraction steam flow in the condensing final feedwater heater also comprises:

using the higher pressure extraction steam flow in a condensing Exergetic Heater thereby increasing the thermal system's final feedwater temperature entering the steam generator and thereby improving the system's thermal efficiency.

4. A device for a thermal system in which a final feedwater temperature is to be increased, said thermal system consisting of a steam generator and a regenerative Rankine cycle comprising a turbine supplying an extraction steam flow and a feedwater path carrying a high pressure feedwater flow, the device comprising:

a reboiler installed in the thermal system;

a pipe carrying a portion of the high pressure feedwater flow from the feedwater path to an inlet of the reboiler;

a means of heating the reboiler producing a reboiler vaporized feedwater flow;

a thermocompressor installed in the thermal system having an inlet connection for a supply steam flow, an inlet connection for a motive steam flow, and an outlet connection for a higher pressure extraction steam flow;

a pipe carrying the extraction steam flow from the turbine to the inlet connection for the supply steam flow;

a pipe carrying the reboiler vaporized feedwater flow from the reboiler to the inlet connection for the motive steam flow;

a heat exchanger installed in the feedwater path with a means of feedwater heating, resulting in an installed Exergetic Heater; and a pipe carrying the higher pressure extraction steam flow from the thermocompressor, to the installed Exergetic Heater, and, by cooling the higher pressure extraction steam flow, thereby increasing the final feedwater temperature.

5. The device of claim 4 wherein the heat exchanger installed in the feedwater path with a means of feedwater heating, also comprises:

a heat exchanger having a shell-side and tube-side configuration installed in the feedwater path with a means of feedwater heating, resulting in the installed Exergetic Heater.

6. A control device for quantifying the operation of a thermal system in which a final feedwater temperature is to be controlled, the thermal system consisting of a steam generator and a regenerative Rankine cycle comprising a turbine, a feedwater path, a thermocompressor, a reboiler employing a reboiler heat source and an Exergetic Heater; the turbine supplying an extraction steam flow to the thermocompressor as a compressor supply flow, the feedwater path supplying a feedwater flow to the reboiler whose output is a reboiler vaporized feedwater flow, the thermocompressor using the reboiler vaporized feedwater flow as a compressor motive steam flow, the feedwater path supplying a feedwater flow to the Exergetic Heater, the Exergetic Heater supplying the steam generator with a final feedwater flow, the control device comprising:

an instrument for measuring a temperature of the final feedwater flow, producing the final feedwater temperature;

a control valve installed to control the feedwater flow to the reboiler, having as an input a signal to control the feedwater flow to the reboiler if necessitated for controlling the final feedwater temperature;

a device for controlling the reboiler heat source, having as an input a signal for controlling the reboiler heat source if necessitated for controlling the final feedwater temperature;

a control valve installed to control the compressor supply flow, having as an input a signal for controlling the compressor supply flow if necessitated for controlling the final feedwater temperature;

a control valve installed to control the compressor motive steam flow having as an input a signal for controlling the compressor motive steam flow if necessitated for controlling the final feedwater temperature; and a control device for controlling the final feedwater temperature having as an input signal the final feedwater temperature, and having as an output signal at least one signal selected from the group comprising: the signal to control the feedwater flow to the reboiler, the signal for controlling the reboiler heat source, the signal for controlling the compressor supply flow, and the signal for controlling the compressor motive steam flow.

7. A control device for increasing a boiler efficiency of a thermal system, the thermal system consisting of a steam generator and a regenerative Rankine cycle comprising a turbine a feedwater path, a compressor device, a reboiler employing a reboiler heat source, and an Exergetic Heater; the turbine supplying an extraction steam flow to the compressor device as a compressor supply flow, the feedwater path supplying a feedwater flow to the reboiler whose output is a reboiler vaporized feedwater flow, the compressor device using the reboiler vaporized feedwater flow as a compressor motive steam flow, the feedwater path supplying a feedwater flow to the Exergetic Heater, the Exergetic Heater supplying the steam generator with a final feedwater flow, the control device comprising:

an instrument for measuring a temperature of the final feedwater flow, producing an output of a final feedwater temperature signal;

a device for computing the boiler efficiency of the thermal system, producing an output of a boiler efficiency signal;

a control valve installed to control the feedwater flow to the reboiler, having as an input a signal to control the feedwater flow to the reboiler if necessitated for controlling the final feedwater temperature;

a device for controlling the reboiler heat source, having as an input a signal for controlling the reboiler heat source if necessitated for controlling the final feedwater temperature;

a control valve installed to control the compressor supply flow, having as an input a signal for controlling the compressor supply flow if necessitated for controlling the final feedwater temperature;

a control valve installed to control the compressor motive steam flow, having as an input a signal for controlling the compressor motive steam flow if necessitated for controlling the final feedwater temperature; and a control device for increasing the boiler efficiency of the thermal system by controlling the final feedwater temperature, said device comprising inputs of the final feedwater temperature signal and the boiler efficiency signal, and having as an output signal at least one signal selected from the group comprising: the signal to control the feedwater flow to the reboiler, the signal for controlling the reboiler heat source the signal for controlling the compressor supply flow and the signal for controlling the compressor motive steam flow.

8. The control device of claim 7, wherein the device for computing the boiler efficiency of the thermal system, includes:

a device for computing the boiler efficiency employing a procedure selected from the group comprising: an Input/Loss Method, an ASME PTC 4 Method, an ASME PTC 4.1 Method, a DIN 1942 Method, a Control-Oriented Method and a DCS-Based Method.

9. A control device for increasing a thermal efficiency of a thermal system, the thermal system consisting of a steam generator and a regenerative Rankine cycle comprising a turbine, a feedwater path, a compressor device, a reboiler employing a reboiler heat source, and an Exergetic Heater; the turbine supplying an extraction steam flow to the compressor device as a compressor supply flow, the feedwater path supplying a feedwater flow to the reboiler whose output is a reboiler vaporized feedwater flow, the compressor device using the reboiler vaporized feedwater flow as a compressor motive steam flow, the feedwater path supplying a feedwater flow to the Exergetic Heater, the Exergetic Heater supplying the steam generator with a final feedwater flow, the control device comprising:

an instrument for measuring a temperature of the final feedwater flow, producing an output of a final feedwater temperature signal;

a device for computing the thermal efficiency of the thermal system, producing an output of a thermal efficiency signal;

a control valve installed to control the feedwater flow to the reboiler, having as an input a signal to control the feedwater flow to the reboiler if necessitated for controlling the final feedwater temperature;

a device for controlling the reboiler heat source, having as an input a signal for controlling the reboiler heat source if necessitated for controlling the final feedwater temperature;

a control valve installed to control the compressor supply flow, having as an input a signal for controlling the compressor supply flow if necessitated for controlling the final feedwater temperature;

a control valve installed to control the compressor motive steam flow, having as an input a signal for controlling the compressor motive steam flow if necessitated for controlling the final feedwater temperature; and a control device for increasing the thermal efficiency of the thermal system by controlling the final feedwater temperature, said device comprising inputs of the final feedwater temperature signal and the thermal efficiency signal, and having as an output signal at least one signal selected from the group comprising: the signal to control the feedwater flow to the reboiler, the signal for controlling the reboiler heat source, the signal for controlling the compressor supply flow, and the signal for controlling the compressor motive steam flow.

10. The control device of claim 9, wherein the device for computing the thermal efficiency of the thermal system, includes:

a device for determining a regenerative Rankine cycle efficiency comprising power produced by the regenerative Rankine cycle and energy flow consumed by the regenerative Rankine cycle; and a device for determining a boiler efficiency based on a procedure selected from a group comprising: an Input/Loss Method, an ASME PTC 4 Method, an ASME PTC 4.1 Method, a DIN 1942 Method, a Control-Oriented Method, a DCS-Based Method, and a constant value.

* * * * *